US011772870B2

(12) United States Patent
Kronkright et al.

(10) Patent No.: US 11,772,870 B2
(45) Date of Patent: Oct. 3, 2023

(54) SYSTEM FOR TRANSPORTING FRAGILE OBJECTS

(71) Applicant: THE SUPPORTING ORGANIZATION FOR THE GEORGIA O'KEEFFE MUSEUM, Santa Fe, NM (US)

(72) Inventors: Dale Paul Kronkright, Santa Fe, NM (US); Robert James White, Waterloo, IA (US)

(73) Assignee: THE SUPPORTING ORGANIZATION FOR THE GEORGIA O'KEEFFE MUSEUM, Santa Fe, NM (US)

( * ) Notice: Subject to any disclaimer, the term of this patent is extended or adjusted under 35 U.S.C. 154(b) by 141 days.

(21) Appl. No.: 17/314,926

(22) Filed: May 7, 2021

(65) Prior Publication Data

US 2022/0355997 A1 Nov. 10, 2022

(51) Int. Cl.
*B65D 81/07* (2006.01)
*B65D 25/10* (2006.01)

(52) U.S. Cl.
CPC ..... *B65D 81/07* (2013.01); *B65D 25/10* (2013.01); *B65D 2313/02* (2013.01); *B65D 2313/04* (2013.01)

(58) Field of Classification Search
CPC ..... B65D 81/07
See application file for complete search history.

(56) References Cited

U.S. PATENT DOCUMENTS

| | | | | |
|---|---|---|---|---|
| 2,417,347 | A | 3/1947 | Brown | |
| 3,044,161 | A | 7/1962 | Morrison | |
| 3,268,199 | A | 8/1966 | Kordyban et al. | |
| 3,655,034 | A | 4/1972 | Stollman et al. | |
| 3,690,540 | A | 9/1972 | Hardigg | |
| 3,844,203 | A * | 10/1974 | Takahashi | B65D 90/0066 220/592.2 |
| 4,013,170 | A | 3/1977 | Hutterer | |
| 4,015,715 | A | 4/1977 | Keif | |
| 4,749,164 | A | 6/1988 | Leo et al. | |
| 4,766,708 | A | 8/1988 | Sing | |
| 4,856,626 | A | 8/1989 | Nakanishi | |
| 4,865,200 | A | 9/1989 | Sullivan et al. | |
| 4,877,136 | A | 10/1989 | Mizuno et al. | |

(Continued)

FOREIGN PATENT DOCUMENTS

| | | | |
|---|---|---|---|
| CA | 2826895 | A1 | 3/2014 |
| DE | 942207 | U1 | 8/1997 |

(Continued)

OTHER PUBLICATIONS

Turtle uNLtd—The safe, most innovative & sustainable museum crate in the world from Turtle uNLtd; https://turtlebox.com/en/products/turtle/; 4 pages.

(Continued)

*Primary Examiner* — Mollie Impink
(74) *Attorney, Agent, or Firm* — BAKER BOTTS L.L.P.

(57) ABSTRACT

According to certain embodiments, a system comprises an outer box and an inner box suspended within the outer box by one or more vibration isolators. The inner box comprises a mounting system adapted to facilitate mounting one or more objects within the inner box.

30 Claims, 18 Drawing Sheets

(56) References Cited

U.S. PATENT DOCUMENTS

| | | | | |
|---|---|---|---|---|
| 5,100,096 | A | 3/1992 | Mizuno et al. | |
| 5,314,149 | A | 5/1994 | Pim et al. | |
| 5,314,159 | A | 5/1994 | Szarata | |
| 5,518,118 | A | 5/1996 | Pütz et al. | |
| 5,595,301 | A | 1/1997 | Pütz et al. | |
| 5,640,793 | A | 6/1997 | Fischer | |
| 5,803,258 | A * | 9/1998 | Gonzalez-Rivera | B65D 85/30 206/454 |
| 5,819,943 | A | 10/1998 | Depuy | |
| 5,924,261 | A | 7/1999 | Fricke | |
| 6,263,604 | B1 | 7/2001 | Williams | |
| 6,305,545 | B1 | 10/2001 | Morrow | |
| 6,540,080 | B2 | 4/2003 | Moreyra | |
| 6,547,049 | B1 | 4/2003 | Tomlison | |
| 6,648,295 | B2 | 11/2003 | Herren et al. | |
| 6,651,948 | B2 | 11/2003 | Szarata | |
| 6,802,405 | B2 | 10/2004 | Barcock et al. | |
| 6,923,298 | B2 | 8/2005 | Tanner | |
| 7,140,508 | B2 | 11/2006 | Kuhn et al. | |
| 7,644,820 | B2 | 1/2010 | Höhne et al. | |
| 8,172,194 | B2 | 5/2012 | Cummins et al. | |
| 8,322,532 | B2 | 12/2012 | Schafer et al. | |
| 8,397,411 | B2 * | 3/2013 | Russo | A47G 1/17 434/428 |
| 10,836,554 | B2 | 11/2020 | Kronkright et al. | |
| 2003/0051958 | A1 | 3/2003 | Esche | |
| 2007/0012530 | A1 | 1/2007 | Garcia | |
| 2007/0119794 | A1 | 5/2007 | Hidaka et al. | |
| 2007/0131574 | A1 | 6/2007 | Aoki | |
| 2010/0051778 | A1 | 3/2010 | Wu | |
| 2012/0138768 | A1 | 6/2012 | Anderssohn et al. | |
| 2013/0233760 | A1 | 9/2013 | Polando | |
| 2014/0021665 | A1 | 1/2014 | Han et al. | |
| 2016/0123422 | A1 | 5/2016 | Keinänen et al. | |
| 2017/0036851 | A1 | 2/2017 | Kronkright et al. | |
| 2017/0037926 | A1 | 2/2017 | Kronkright et al. | |
| 2017/0037928 | A1 | 2/2017 | Kronkright et al. | |
| 2017/0291749 | A1 | 10/2017 | Blackway | |
| 2017/0328442 | A1 * | 11/2017 | Gilbert | F16F 3/08 |
| 2019/0322445 | A1 | 10/2019 | Farrar et al. | |
| 2019/0335926 | A1 | 11/2019 | Farrar et al. | |
| 2022/0127044 | A1 * | 4/2022 | Kracht | B65D 81/107 |

FOREIGN PATENT DOCUMENTS

| | | | |
|---|---|---|---|
| EP | 0518803 | A1 | 12/1992 |
| EP | 0842866 | A1 | 5/1998 |
| EP | 1099876 | A1 | 5/2001 |
| EP | 2392836 | A1 | 12/2011 |
| GB | 857892 | A | 1/1961 |
| NL | 2018589 | A | 6/2017 |
| WO | 2018115808 | A1 | 6/2018 |
| WO | 2018115809 | A1 | 6/2018 |
| WO | 2018115810 | A1 | 6/2018 |
| WO | 2021019241 | A1 | 2/2021 |

OTHER PUBLICATIONS

The revolutionary advanced corner block T+; https://turtlebox.com/en/products/t/; 6 pages.

"Art in Transit Studies in the Transport of Paintings", "International Conference on the Packing and Transportation of Paintings", Sep. 9-Sep. 11, 1991.

Nobuyuki Kamba, Ph.D., "The Art of Packaging to Protect Cultural Assets", The Art of Innovation—Concept to Reality Summer/Fall 2012, pp. 4-7, 2012.

Rick Yamada, "Wire Rope Isolators: Shock and Vibration Mitigation in the Packing of Museum Artifacts", Paccin, Preparation, Art Handling, Collections Care Information Network, 11 pages, Mar. 31, 2014.

Extended European Search Report corresponding to EP22166080, dated Aug. 29, 2022, 7 pages.

* cited by examiner

25 Modes

25 Modes

10 Modes

10 Modes

5 Modes

5 Modes

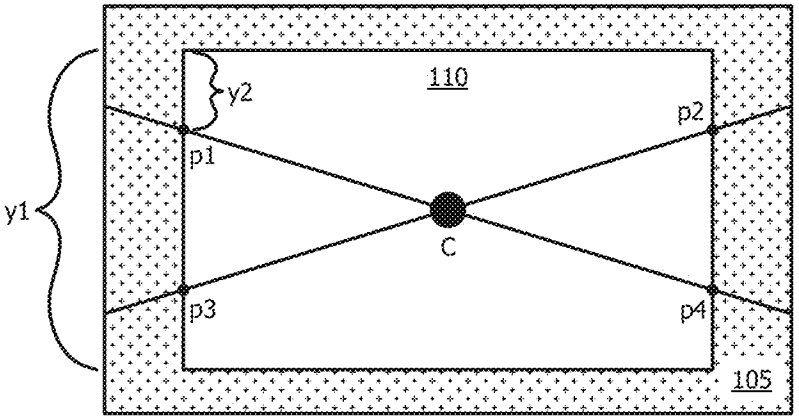
FIG. 7B
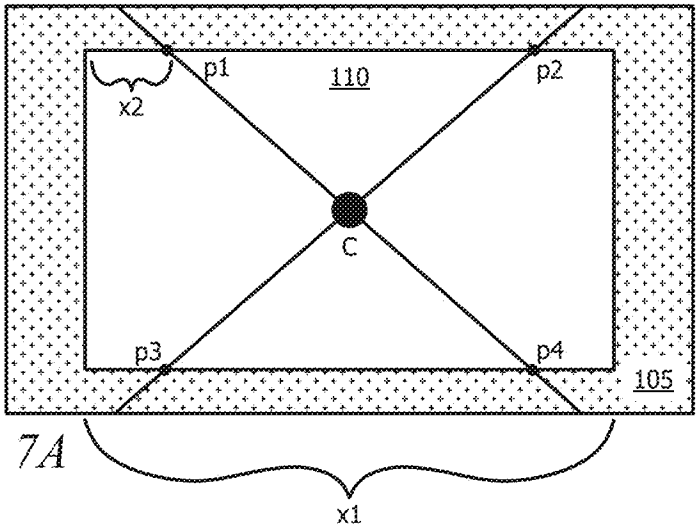
FIG. 7A
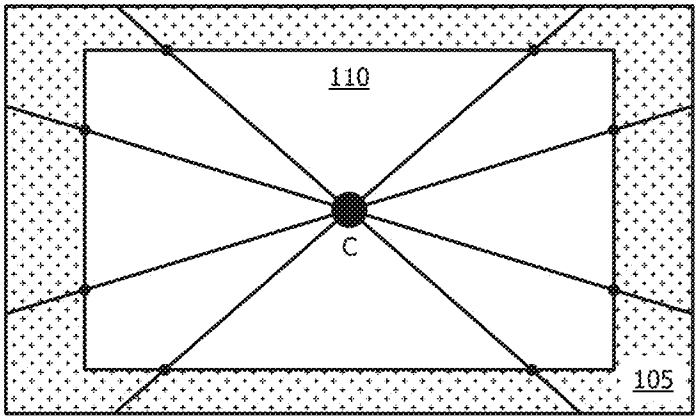
FIG. 7C
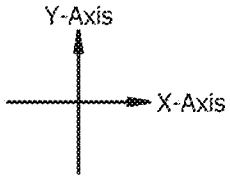

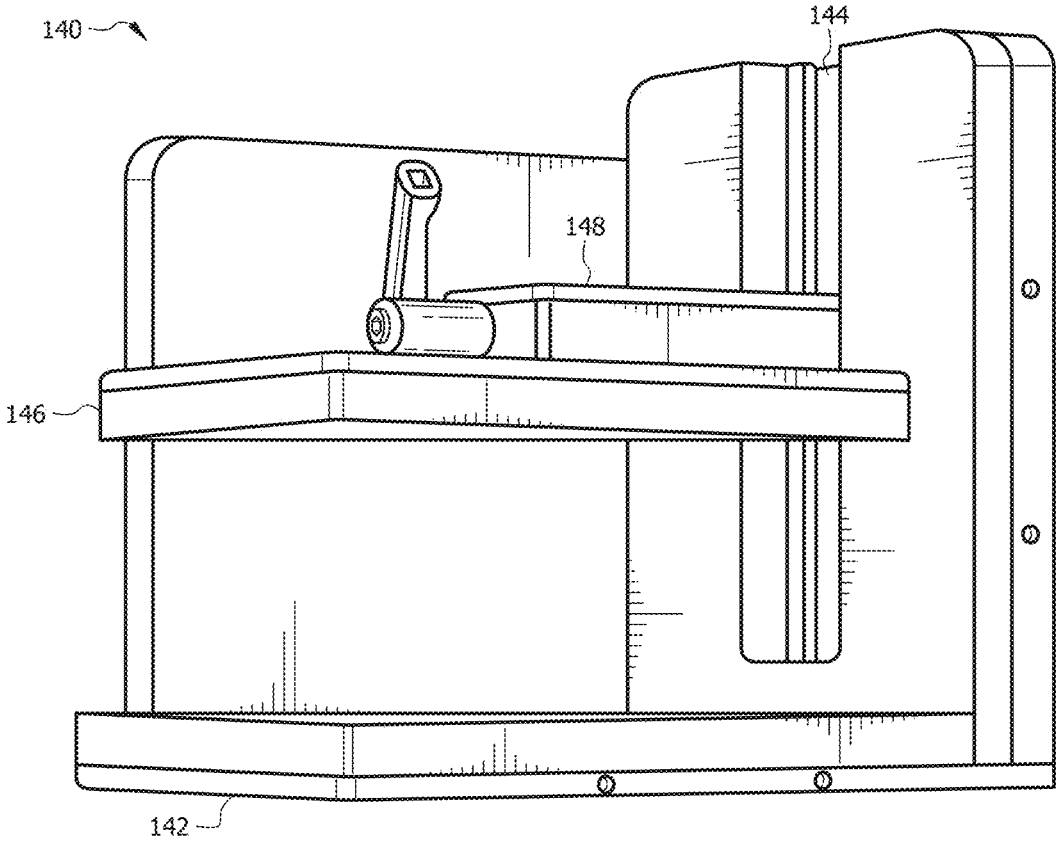
FIG. 10
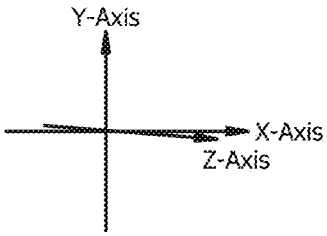

SYSTEM FOR TRANSPORTING FRAGILE OBJECTS

TECHNICAL FIELD

Certain embodiments of the present disclosure relate to a system for transporting fragile objects.

BACKGROUND

Fragile objects may be at risk of becoming damaged when transported from one location to another. To minimize the risks, fragile objects are traditionally transported in wooden crates. The wooden crates are cushioned with foam intended to protect the fragile object in the event that the wooden crate is dropped. Unfortunately, traditional wooden crates may fail to adequately protect fragile objects from damage.

SUMMARY

Embodiments of the present disclosure may reduce the risk of a fragile object becoming damaged during transit. For example, disclosed herein is a vibration-isolating system.

According to certain embodiments, a system comprises an outer box and an inner box suspended within the outer box by one or more vibration isolators. The inner box comprises a mounting system adapted to facilitate mounting one or more objects within the inner box.

As examples, the one or more objects that the mounting system is adapted to facilitate mounting within the inner box may comprise one or more fragile objects, such as one or more art objects, for example, one or more paintings (e.g., stretched canvases painted with artwork). In certain embodiments, the plurality of vibration isolators are tuned to provide vibration isolation in a damage frequency range associated with the one or more objects. For example, with respect to embodiments where the fragile object is a painting, the plurality of vibration isolators are tuned to a natural frequency that reduces damaging vibrations imparted on the stretched canvas so as to prevent paint from cracking, crazing, or separating from the stretched canvas.

The system may include one or more additional features, such as any one or more of the following:

In certain embodiments, the inner box further comprises a front cover and a back cover. The front cover is adapted to facilitate access to a first mounting surface of the mounting system when the front cover is open, and the back cover is adapted to facilitate access to a second mounting surface of the mounting system when the back cover is open. An interior portion of the inner box is buffered from changes in temperature and/or relative humidity when the front cover and the back cover are closed.

In certain embodiments, the outer box comprises a plurality of outer box walls, the inner box comprises a plurality of inner box walls, and the mounting system comprises a mounting surface. The plurality of outer box walls include an outer box top wall, an outer box bottom wall, and a plurality of outer box side walls. The plurality of inner box walls include an inner box top wall, an inner box bottom wall, and a plurality of inner box side walls. The inner box is suspended such that when the system is in a stationary and upright orientation, the mounting surface is oriented vertically and none of the inner box walls directly contacts any of the outer box walls.

In certain embodiments, the mounting system comprises a first mounting board and a second mounting board. The second mounting board is arranged parallel to the first mounting board and separated from the first mounting board by a distance. As an example, in certain embodiments, the distance is at least 25 millimeters. The distance is used as a strategy to achieve the desired stiffness. The stiffness then in turn is used to achieve the desired natural frequency. As another example, in certain embodiments, the distance yields a natural frequency of the first mounting board and the second mounting board greater than or equal to 100 Hz.

In certain embodiments, the mounting system further comprises a plurality of mounting bolsters. Each mounting bolster is adapted to facilitate mounting the one or more objects onto a mounting surface of the mounting system. Each mounting bolster comprises a positioning mechanism. The positioning mechanism can be arranged in a first mode or a second mode. When the positioning mechanism is arranged in the first mode, the positioning mechanism is adapted to facilitate moving the mounting bolster in any direction along the mounting surface. When the positioning mechanism is arranged in the second mode, the positioning mechanism is adapted to facilitate locking the mounting bolster into a fixed position on the mounting surface. As an example, in certain embodiments, the positioning mechanism comprises one or more magnets. As another example, in certain embodiments, the positioning mechanism comprises hook-and-loop fasteners (e.g., Velcro).

In certain embodiments, each mounting bolster comprises a pad adapted to secure an object to the mounting bolster when the pad is in a first position and release the object from the mounting bolster when the pad is in a second position. In certain embodiments, the pad is adapted to be locked into the first position using a torque wrench.

In certain embodiments, each of the plurality of vibration isolators attaches to the inner box at a respective attachment point. Each attachment point avoids locations within a distance of an inner box corner nearest the respective attachment point. As a first example, in certain embodiments, the plurality of vibration isolators include at least one vibration isolator with an attachment point along a vertical surface of the inner box and the distance comprises at least 10% of a vertical dimension of the inner box. As a second example, in certain embodiments, the plurality of vibration isolators include at least one vibration isolator with an attachment point along a horizontal surface of the inner box and the distance comprises at least 10% of a horizontal dimension of the inner box. In some embodiments, each attachment point is substantially centered with respect to a depth dimension of the inner box.

In certain embodiments, each of the plurality of vibration isolators attaches to the inner box at a respective attachment point, and each attachment point avoids locations for which a modal response associated with the location exceeds a threshold.

In certain embodiments, the plurality of vibration isolators comprises at least four vibration isolators, wherein each of the four vibration isolators is focused at the center of gravity of the inner box.

In certain embodiments, the plurality of vibration isolators comprises at least a first pair of vibration isolators diagonally opposed through a center of gravity of the inner box and a second pair of vibration isolators diagonally opposed through the center of gravity of the inner box.

In certain embodiments, each vibration isolator in the plurality of vibration isolators is tuned such that a force-displacement dynamic of said vibration isolator is within a pre-determined tolerance of a force-displacement dynamic of the other vibration isolators.

In certain embodiments, the plurality of vibration isolators are tuned to a natural frequency below a damage range associated with the one or more objects.

In certain embodiments, the plurality of vibration isolators comprises at least one multi-stage vibration isolator, the at least one multi-stage vibration isolator adapted to provide a first mode of vibration isolation in response to a first vibration amplitude and to provide a second mode of vibration isolation in response to a second vibration amplitude. For example, in certain embodiments, the second vibration amplitude is greater than the first vibration amplitude and the second mode of vibration isolation is more rigid than the first mode of vibration isolation. In certain embodiments, the at least one multi-stage vibration isolator is further adapted to provide a third mode of vibration isolation, a jounce bumper, that provides vibration protection with the response to a third vibration amplitude.

In certain embodiments, the system further comprises a loading mechanism adapted to hold the mounting system steady when in a first mode and to engage the plurality of vibration isolators when in a second mode. Certain embodiments further comprise a stopper that prevents at least one of the outer box or the inner box from closing or locking when the loading mechanism is in the first mode.

Certain embodiments of the present disclosure may provide one or more technical advantages. Certain embodiments may protect a canvas painting, art, or other fragile object from vibration and/or shock that can occur during transit. As an example, certain embodiments may provide a vibration-isolating system that attenuates and damps vibrations and/or reduces transmitted shock experienced by the object in transit. The system can be configured to isolate damaging frequencies and/or to absorb shock in the event of a drop. Certain embodiments may tune or customize protection based on the particular object being transported, for example, depending on the fundamental damage frequency of the object. Certain embodiments may have all, some, or none of these advantages. Other advantages will be apparent to persons of ordinary skill in the art.

BRIEF DESCRIPTION OF THE DRAWINGS

For a more complete understanding of the disclosed embodiments and their features and advantages, reference is now made to the following description, taken in conjunction with the accompanying drawings, in which:

In FIG. 2, a front cover of the inner box has been removed in order to show the inside of the inner box.

FIGS. 7A, 7B, and 7C each illustrate an example of attachment points for attaching vibration isolators to the inner box, in accordance with certain embodiments.

FIGS. 10-13 illustrate examples of mounting bolsters, in accordance with certain embodiments.

DETAILED DESCRIPTION

Figure 1:
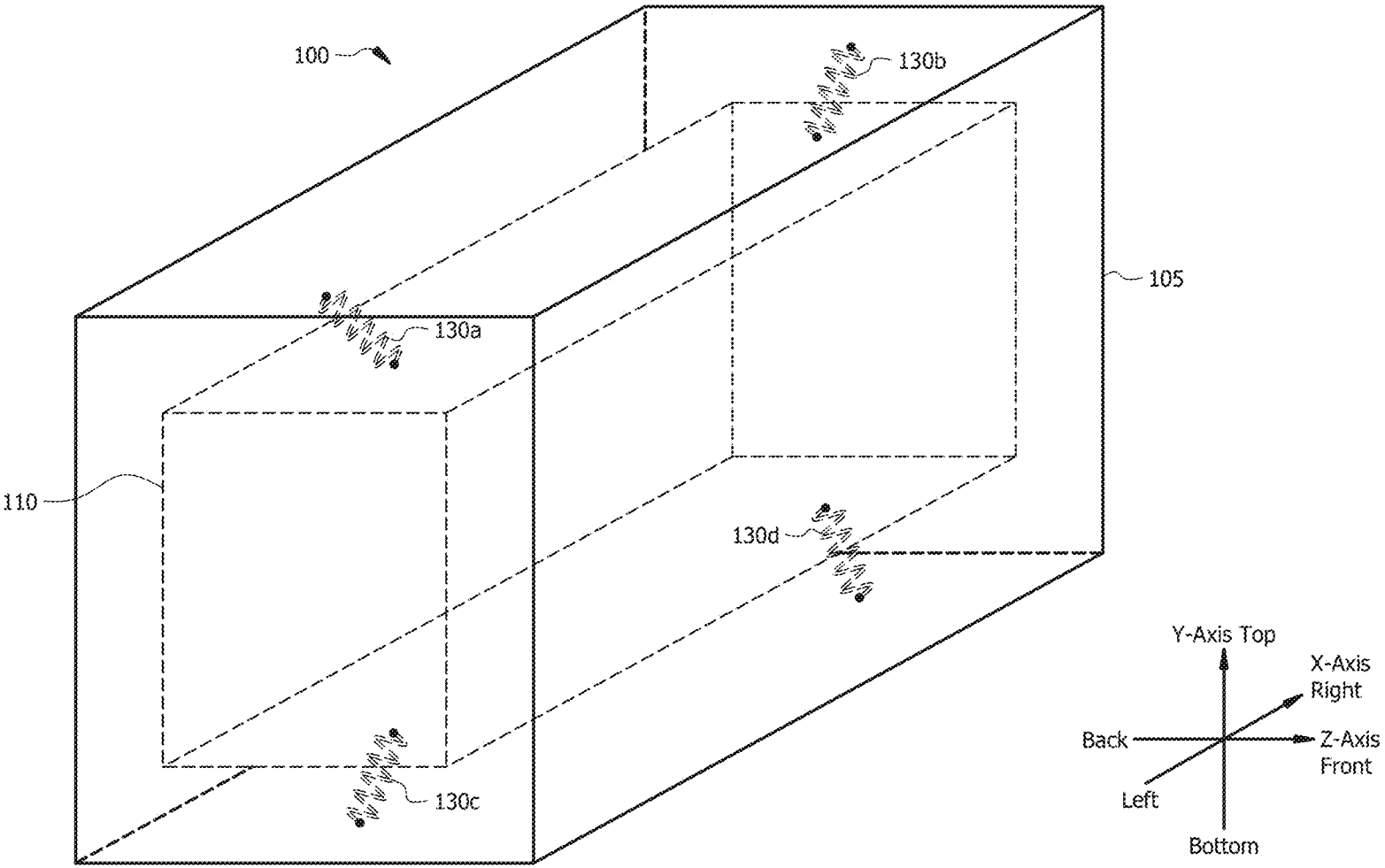
FIG. 1 illustrates an example of a system comprising an outer box and an inner box suspended within the outer box by a plurality of vibration isolators, in accordance with certain embodiments.

Fragile objects are traditionally transported in wooden crates cushioned with foam. The foam is intended to protect the fragile object in the event that the wooden crate is dropped or in a collision. Traditional wooden crates, however, may fail to adequately protect the fragile object from damage. For example, the fragile object may be subjected to significant vibrations when transported by a truck, aircraft, or other vehicle. As the encountered transit vibrations approach the resonant frequencies of the fragile object, those vibrations cause the fragile object to vibrate with increasing amplitude, stressing the materials and structures of the object which results in cracks or other damage. As an example, the fragile object may be a painting on a canvas. When resonant vibrations occur, the canvas oscillates and the paints restrain the canvas movement through tension and compression thereby damping the kinetic energy of the canvas. If the stresses to the adhesion and cohesion bonds remaining in the aged paints exceed stress limits, the paint will crack and separate either at the point of adhesion of the paint to the canvas or between paint layers. The paint layers increasingly transform from a semi-continuous film to a series of fragmented sections. Every time a crack forms, that crack becomes the focal point of movement in that area. As more movement occurs, the canvas and paints become more and more damaged at the cracks. As the painting ages, it tends to become less flexible and more brittle. Thus older paintings are increasingly prone to damage as a result of travel vibrations.

The most damaging transit-related vibrations generally occur at frequencies similar to the object's natural frequency. At the object's natural frequency, the amplitude may become very great, limited only by the system's internal damping. The first natural frequency of a painting will generally be in the range of approximately 5-50 Hz and the natural frequency of a glass sculpture or ceramic will generally be in the range of approximately 150-1000 Hz. In developing the systems and methods disclosed herein, it was discovered that traditional wooden crates not only fail to reduce damaging vibrations, they transmit and actually amplify many vibrations due to a poorly tuned system natural frequency. For example, testing was performed on a traditional wooden crate configured with accelerometers and scanning laser vibrometers placed or focused on a painting, on the foam cushioning, on the wooden crate, and on the bed of the truck transporting the painting. The testing underscored the data suggested in US MIL-STD-810 for common commercial truck carriers that transit vibrations are greatest in the regions of 10-60 Hz and 100-160 Hz. Testing further demonstrated that traditional wood crates and foam cushioning have relatively low natural frequencies (approximately 20-100 Hz) and therefore amplify transit vibrations up to a frequency of 140% of the system's first natural frequency. If the system's first natural frequency is not tuned low enough, low frequency transit vibrations are amplified to damaging levels. At every configuration in which foam was used, vibration across the fragile payload increased. For example, the displacement energy experienced by a painting cushioned in foam was worse than if the painting had been placed directly on the bed of the truck. By amplifying the displacement energy, the foam increased the risk of damage to the painting.

The results obtained by testing the foam were unexpected because conventionally foam was thought to be beneficial for protecting fragile objects and because foam behaves differently when observed on its own as compared to when it is observed carrying a load. Both in product literature and in experimental tests on engineering shaker tables and actual road tests, cushioning foams made from open-cell polyurethane (PEU) and extruded, closed-cell polyethylene foams exhibit consistent natural frequencies between 3 Hz-100 Hz, depending upon the configurations used as container cushions and the payload compressions created. These are precisely the frequencies transmitted in all modes of motor, rail and air freight transportation. Because the input vibration frequencies approximate or replicate the natural frequencies of the foam cushions, both the cushions and the wood walls of the crate move into phase and amplify the transmitted excursions of the truck bed or wall.

Certain embodiments of the present disclosure may provide solutions to this and other problems associated with traditional systems for transporting fragile objects. For example, certain embodiments may reduce exposure to vibration frequencies that would otherwise damage a fragile object in transit, such as vibrations in lower frequency ranges (e.g., vibrations less than approximately 150 Hz, vibrations less than approximately 100 Hz, or other frequencies depending on the natural frequency of the object being transported). Certain embodiments use a suspension system to provide tunable protection from vibration and shock. For example, the suspension system may be implemented using a box-in-box design comprising an outer box and an inner box. The inner box is suspended within the outer box by a plurality of vibration isolators, and the inner box comprises a mounting system adapted to facilitate mounting one or more objects within the inner box. The isolators may be tunable to protect the objects from their most damaging vibrations (e.g., based on the natural frequency of the object). The tuning of the isolators can be improved by positioning the one or more objects such that the mass of the suspended components (e.g., the inner box containing the mounting system and the objects carried by the mounting system) retains its center of gravity (CG) at the isolator focal point. The isolators are focused on the system's center of gravity in order to decouple vibration modes. In this manner, an object would move up and down in response to vertical vibration, as opposed to side-to-side or twisting. Because the position of the one or more objects can affect the tuning of the isolators, disclosed herein is an adjustable load-positioning system that allows for adjusting the position of the one or more objects.

For a more complete understanding of the present invention and the advantages thereof, reference is now made to the following description and the accompanying drawings, wherein like numerals are used for like and corresponding parts of the various drawings.

Figure 2:
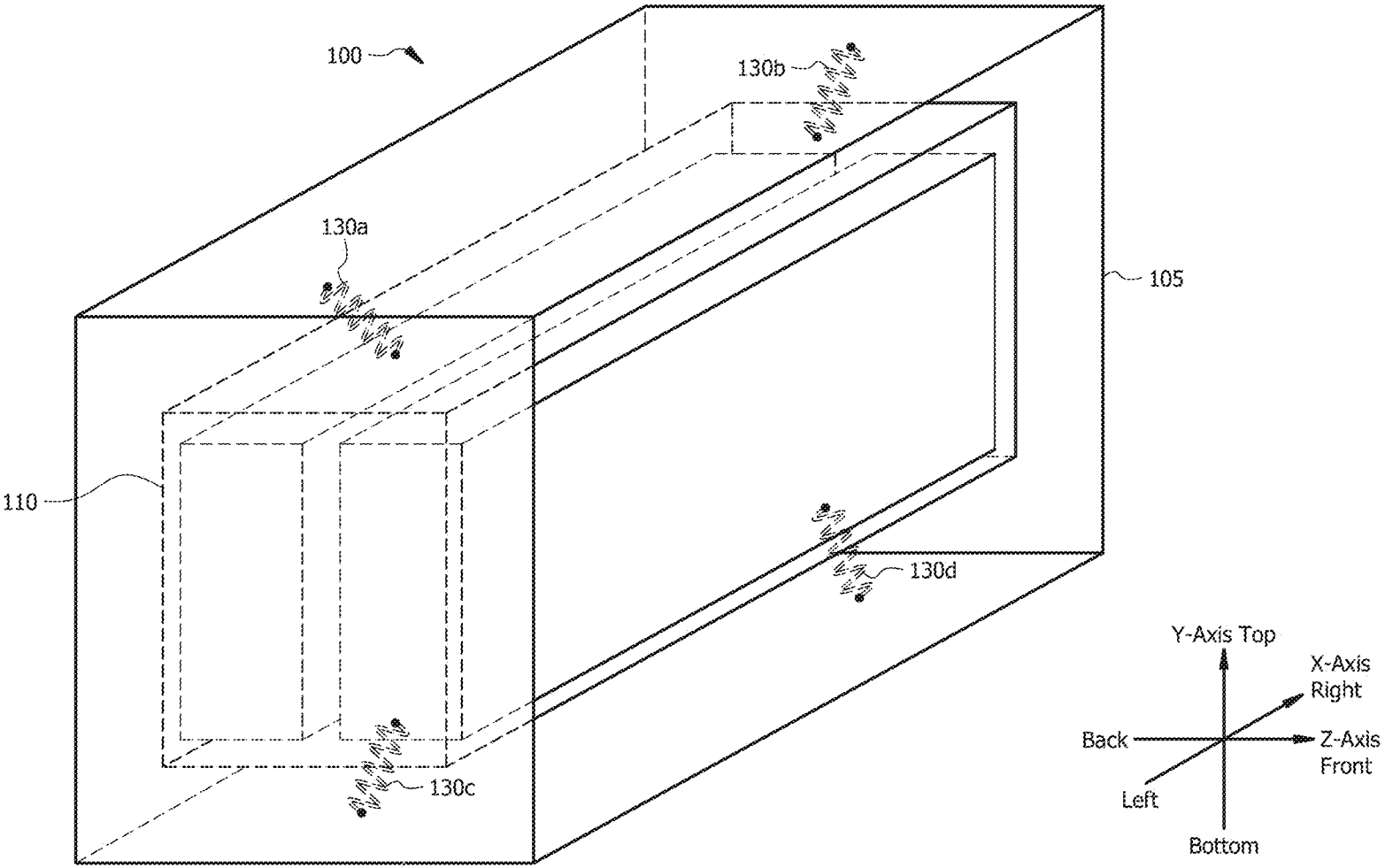
FIG. 2 illustrates an example of a system comprising an outer box and an inner box suspended within the outer box by a plurality of vibration isolators, in accordance with certain embodiments.

FIGS. 1 and 2 illustrate an example of components of a system 100 for transporting and storing an object, in accordance with certain embodiments of the present disclosure. The components of system 100 may include an outer box 105, an inner box 110, and a plurality of vibration isolators 130 adapted to suspend the inner box 110 within the outer box 105. The inner box 110 contains a mounting system adapted to facilitate mounting one or more objects 120 within the inner box 110. In FIG. 1, a front cover of the inner box 110 has been attached to the inner box 110 to show system 100 arranged to store and transport the one or more objects 120. In FIG. 2, the front cover of the inner box 110 has been removed in order to show how the inside of the inner box 110 may be accessed to load and unload the one or more objects 120. For purposes of explanation, FIGS. 1-2 illustrate the orientation of system 100 relative to an x-axis extending in a length direction (e.g., from left to right), a y-axis extending in a height direction (e.g., from bottom to top), and a z-axis extending a width direction (e.g., from back to front), where the bottom of system 100 is positioned to take the gravitational load when system 100 is oriented in an upright orientation (in other words, the bottom of system 100 is positioned on or nearest the floor/ground when system 100 is in an upright position).

In certain embodiments, the outer box 105 comprises a plurality of outer box walls, and the inner box 110 comprises a plurality of inner box walls. For example, the outer box 105 may comprise an outer box top wall, an outer box bottom wall, and a plurality of outer box side walls (e.g., left side, right side, front side, and back side). Similarly, the inner box 110 may comprise an inner box top wall, an inner box bottom wall, and a plurality of inner box side walls (e.g., left side, right side, front side, and back side). Certain embodiments suspend the inner box 110 such that when the system 100 is in a stationary and upright orientation, none of the inner box walls directly contacts any of the outer box walls. This arrangement allows the inner box 110 some range of motion within the outer box 105 in order to respond to vibrations, such as vibrations that system 100 may be subjected to when transported. In this manner, system 100 may protect the one or more objects 120 from damaging vibrations. Examples of objects 120 that may be protected by system 100 include fragile objects, such as museum specimens, artifacts, art objects (e.g., paintings, such as stretched canvases painted with artwork; sculptures, such as glass, marble, or ceramic sculptures; etc.), scientific equipment, musical instruments, and so on. As further explained below, the plurality of vibration isolators 130 can be tuned to a natural frequency that reduces damaging vibrations imparted on the one or more objects 120. In the case of a paintings, for example, the tuning can reduce damaging vibrations imparted on the stretched canvas so as to prevent paint from cracking, crazing, or separating from the stretched canvas. In certain embodiments, the frequency range to be attenuated begins at approximately 8-10 Hz and ends at approximately 40-50 Hz, such as 8-40 Hz, 8-50 Hz, 10-40 Hz, or 10-50 Hz, among others.

The box-in-box design illustrated in FIGS. 1-2 may improve vibration isolation compared to other solutions for protecting objects 120. For example, certain previous solutions set forth in U.S. Patent Publication 2017/0037928 and U.S. Patent Publication 2019/0367242 describe suspending a platform within a case. By contrast, embodiments of the present disclosure suspend an inner box 110 within an outer box 105. The inner box 110 adds rigidity to the system, which reduces internal vibration dynamics and simplifies vibration isolation. For example, the inner box 110, when closed, may comprise at least three rigid panels (a front cover 112*a*, a back cover 112*b*, and at least one mounting board 114) that are arranged in parallel and spaced apart in order to add rigidity to the system/components being suspended from the vibration isolators 130. Using the inner box 110 to increase stiffness enables the vibration isolators to do their job more effectively. For example, the vibration isolators work well when the connection points of the vibration isolators are much stiffer (e.g., 5 to 10 times stiffer) than the vibration isolators themselves. In addition to improving vibration isolation, the box-in-box design improves lateral stability in the z-direction compared to the platform design.

In general, when closed, the outer box 105 may protect the inner box 110 from exposure to an environment outside of the outer box 105 (e.g., light, temperature, humidity, etc.). Similarly, when closed, the inner box 110 may protect the contents of the inner box 110 from exposure to an environment outside of the inner box 110. Protecting the contents of the inner box 110 may include buffering an interior portion of the inner box 110 from changes in temperature and/or relative humidity. In certain embodiments, system 100 may include one or more environmental buffers that contribute to buffering the inside of the inner box 110 from changes in temperature and/or relative humidity. Examples of environmental buffers include thermal buffers (such as insulation layers or thermal phase change material, which may be obtained from Cryopak™ or other manufacturers) and humidity buffers (such as conditioned silica gel material or ArtSorb, which may be obtained from Fuji Silysia Chemical™). As an example, in certain embodiments, the outer box 105's walls and/or the inner box 110's may comprise or may be lined with thermal insulation, volatile organic pollutant absorbents or other environmental buffers. In addition, or in the alternative, certain embodiments position environmental buffers within inner box 110, for example, by placing one or more environmental buffers on, in, or between components of the mounting system (e.g., components such as mounting boards 114 described below with respect to FIGS. 3-4).

The outer box 105 may be any box suitable to contain the inner box 110. The inner box 110 may be any box suitable to carry one or more objects 120. In certain embodiments, the outer box 105 and/or the inner box 110 may be a custom-made box. The custom-made box may be built using parts specified on a parts list. In certain embodiments, the parts may be standard parts, which may help to ensure that the parts are reliable and readily available from various manufacturers. Standard parts refer to parts that are based on specifications defined by a standards group, such as the ASTM International, the International Organization for Standardization (ISO), or other standards groups. In certain embodiments, the parts list may include the materials and dimensions of the box and related parts, such as a number and type of fasteners (e.g., screws, bolts, hinges, channels, guides, locking mechanisms, snaps, gaskets, adhesives, etc.) for coupling components of the box together.

The dimensions of the inner box 110 may be specified to accommodate the size of objects 120 to be carried in the inner box 110. In an embodiment, the inner box 110 can be dimensioned to carry a painting up to 44×44 inches in the x-y plane and to provide lateral stability in the z-direction. Example dimensions of inner box 110 may be in the range of approximately 48 inches to 60 inches in length, approximately 48 inches to 60 inches in height, and approximately 24 inches to 60 inches in width. However, other dimensions could be used, depending on materials used and the object(s) 120 to be carried. Other embodiments may be dimensioned to accommodate a smaller or larger object 120. The dimensions of the outer box 105 can be specified to accommodate the size of the inner box 110 and the vibration isolators 130 that suspend the inner box 110 within the outer box 105. In certain embodiments, the dimensions and/or materials may be specified to improve stability and reduce a likelihood of tipping over the system 100. As an example, the outer box 105 may be dimensioned with a relatively large width compared to its height (such as a width greater than or equal to 35% of its height) to reduce a likelihood of tipping. As another example, the outer box 105's mass may be relatively high and its center of gravity relatively low in order to reduce a likelihood of tipping.

The walls of the outer box 105 and/or the inner box 110 may comprise any suitable material. The material may be selected to impart certain properties, such as lightweight, sturdy, scalable in size, effective at reducing vibrations, puncture resistant, able to provide protection from a catastrophic event (e.g., collision, drop, fall, etc.), and/or able to provide protection from the elements (e.g., moisture, steam, water, heat, dust, smoke, etc.). Certain embodiments use a rigid, high natural frequency, puncture-resistant material, such as metal, plastic, synthetic composite structure, and/or honeycomb structure. An example of such a material includes polypropylene honeycomb in aluminum extrusion. In some embodiments, one or more surfaces of the outer box 105 or the inner box 110 may comprise a Kevlar-like facing that reduces puncture risk. In addition, or in the alternative, in some embodiments, a skin may be applied to one or more surfaces of the outer box 105 or the inner box 110. As an example, a replaceable skin made of vinyl or similar material may be applied to one or more outward-facing surfaces. The skin may protect the box from abrasion or dirt. In some embodiments, a skin may be removable so that it can be replaced if it begins to show signs of wear and tear (e.g., dirt, scratches, etc.). In certain embodiments, the skin may have a color or a design, such as a logo or a box number, which may help distinguish the box from other boxes.

The plurality of vibration isolators 130 suspend the inner box 110 within the outer box 105. For example, each vibration isolator 130 may couple between a wall of the outer box 105 and a wall of the inner box 110 (e.g., a vibration isolator 130 may couple between an interior-facing surface of one of the outer box 105's walls and an exterior-facing surface of one of the inner box 110's walls). Certain embodiments may include, mounts, brackets, and/or other structures that facilitate coupling vibration isolators 130 to the outer box 105 and the inner box 110. The vibration isolators 130 may be coupled at attachment points, as further explained below with respect to FIGS. 5A-7C.

Any suitable vibration isolators 130 may be used. Examples of vibration isolators 130 include multi-stage vibration isolators (such as that described below with respect to FIGS. 8-9), high energy rope mounts (HERMs), wire rope isolators, rubber air bladders, inflatables, smartfoam, springs, or other structures operable to suspend inner box 110. Depending on the embodiment, one type of vibration isolator 130 or a mix of multiple types of vibration isolators 130 may be used. Vibration isolators 130 are configured such that a mounting board 114/mounting surface 116 is oriented in a substantially vertical direction relative to the ground when system 100 is oriented in an upright position.

In certain embodiments, vibration isolators 130 may be tunable/selected in order to achieve isolation from damaging vibration. For example, the plurality of vibration isolators 130 are tuned to a system natural frequency below a damage range associated with the one or more objects 120. For example, because vibration amplitudes are attenuated for frequencies greater than 1.4 times the system natural frequency, certain embodiments tune the inner box 110 (including its contents) to have a natural frequency less than 70% of the lowest frequency to be attenuated.

A vibration isolator 130 may be tuned in any suitable manner. Tuning may be performed at least in part by selecting a suitable number of vibration isolators 130, angle of orientation of vibration isolators 130, attachment point of vibration isolators 130, and so on. Additionally, or in the alternative, when using wire rope isolators, HERMs, or the like as vibration isolators 130, tuning can include selecting loop spacing, loop diameter, wire thickness, number of wires (e.g., if the loops are made of a rope braid), number of loops, and so on. As an example, as the weight of the inner box 110 (including its contents) increases, the wire rope isolator or HERM may be tuned to accommodate the weight (e.g., by changing wire thickness and/or number of loops, decreasing loop diameter, etc.). Similarly, when using springs (e.g., helical springs) or the like as vibration isolators 130, tuning can include selecting free length, outer diameter, wire thickness, number of turns, and so on. Embodiments using multi-stage isolators may be tuned to provide multiple stages of vibration isolation.

In certain embodiments, each vibration isolator 130 is tuned such that a force-displacement dynamic of said vibration isolator 130 is within a pre-determined tolerance of a force-displacement dynamic of the other vibration isolators 130. To achieve substantially the same force-displacement dynamic, the vibration isolators 130 may need to be tuned separately, depending on their position within system 100. For example, depending on their position within system 100, certain vibration isolators 130 may tend to experience heavier loading and may therefore be tuned to support more weight than other vibration isolators 130. Alternatively, in other embodiments, vibration isolators may all be the same type of isolator (e.g., the same model of isolator with the same tuning properties).

In certain embodiments, a cushioning material/structure, such as a foam material/structure can be positioned through a space formed by loops of a vibration isolator 130 (e.g., for a vibration isolator 130 comprising a coil structure, a foam structure can be placed through the space at the core of the coil). The cushioning material/structure acts as a safety stop to provide impact attenuation and prevent vibration isolator 130 from crimping or creasing in the event of a drop or similar impact. In certain embodiments, the cushioning structure/material may be made of a material that is soft and cushy in low-impulse environments (e.g., impulses due to vibrations) and that stiffens in high-impulse environments (e.g., impulse due to dropping case 200). Examples include an impact-responsive, variable stiffness foam such as smart-foam, urethane foam (for example PoronXRD urethane), or other material that can compress rapidly and form chemical crosslinks that stiffen and absorb energy in high-impulse environments. The cushioning material/structure may have any suitable shape, such as a block shape, a cylindrical shape, or, more generally, a mass of foam. In certain embodiments, the width/diameter of the cushioning material/structure is approximately half of the diameter of a loop of the vibration isolator 130. This may allow some air space for vibration isolator 130 to flex in low-impulse environments without engaging the cushioning material/structure. In certain embodiments, each vibration isolator 130 can be configured with a cushioning material/structure as a safety stop.

Figure 3:
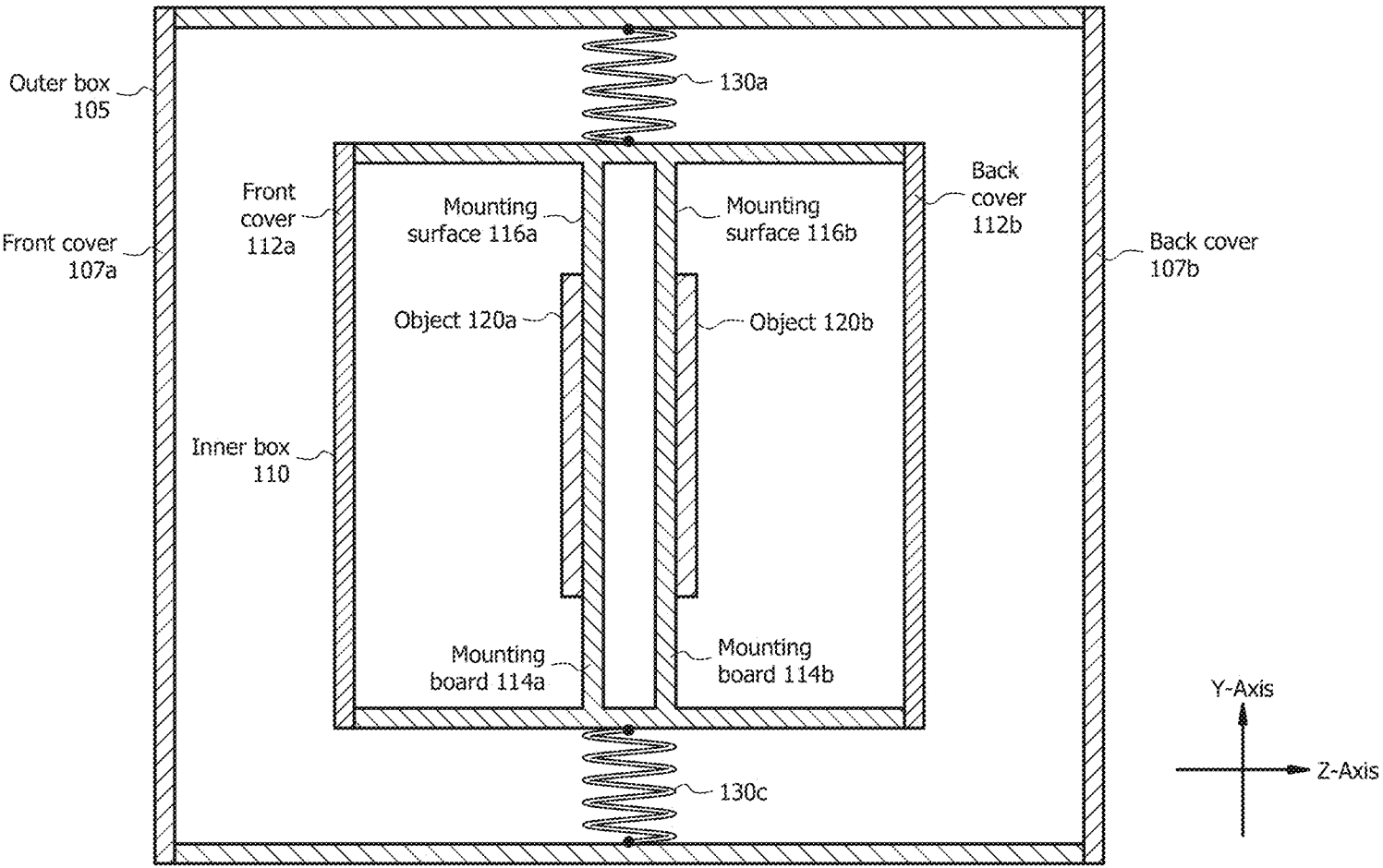
FIG. 3 illustrates an example cross-sectional view of a system comprising an outer box and an inner box suspended within the outer box by a plurality of vibration isolators, in accordance with certain embodiments.

FIG. 3 illustrates a cross-sectional view of an embodiment of the system 100 described above with respect to FIGS. 1-2. The embodiment shown in FIG. 3 allows system 100 to carry objects 120 on two sides, front and back. In the example of FIG. 3, the outer box 105 includes a front cover 107*a* that opens to facilitate access to the front of the inner box 110, and the outer box 105 includes a back cover 107*b* that opens to facilitate access to the back of the inner box 110. When closed, the outer box 105's front cover 107*a* and back cover 107*b* act as the front wall and back wall, respectively, of the outer box 105. Similarly, the inner box 110 includes a front cover 112*a* that opens to facilitate access to a first mounting board 114*a* comprising a first mounting surface 116*a* facing the front side of the inner box 110. The inner box 110 also includes a back cover 112*b* that opens to facilitate access to a second mounting board 114*b* comprising a second mounting surface 116*b* facing the back side of the inner box 110. When closed, the inner box 110's front cover 112*a* and back cover 112*b* act as front and back walls, respectively, of the inner box 110. An interior portion of the inner box 110 is buffered from changes in temperature and relative humidity when the inner box 110's front cover 112*a* and back cover 112*b* are closed.

A cover may refer to any component suitable for opening and closing a box. In certain embodiments, one or more of covers 107 may be fully detachable (to open the outer box 105) and re-attachable (to close the outer box 105) and/or one or more of covers 112 may be fully detachable (to open the inner box 110) and re-attachable (to close the inner box 110). For example, the system 100 may include a plurality of latches to facilitate detaching and attaching covers 107 and/or 112. Alternatively, in certain embodiments, one or more covers 107 or 112 may be arranged as a door. As an example, cover 107 may connect to a top, bottom, left, or right wall of the outer box 105 via a hinge mechanism that allows cover 107 to be used as a door for accessing the inside of the outer box 105. Similarly, cover 112 may connect to a top, bottom, left, or right wall of the inner box 105 via a hinge mechanism that allows cover 112 to be used as a door for accessing the inside the inner box 105. Alternatively, in certain embodiments, cover 107/cover 112 may simply be a wall of the outer box 105/inner box 110 comprising a cutout that frames a door integrated on that wall. In certain embodiments, covers 107 and 112 may be arranged to allow the inner box 110 to be loaded and unloaded while in the upright position. Loading in the upright position may allow for safer and more efficient handling of objects 120, including the option of loading objects 120 from both the front and the back of the inner box 110.

For any of the types of covers 107 or 112 discussed above, certain embodiments may include one or more gaskets, such as one or more bead gaskets, which may be positioned at the seams of the opening where the cover 107/112 (or a door portion of the cover 107/112) attaches to the outer box 105/inner box 110. In this manner, the gasket may provide a water resistant seal that prevents moisture and debris from getting into the outer box 105/inner box 110 when the cover 107/112 is closed. One or more guides (such as spring-loaded alignment snaps) can be included in order to facilitate aligning cover 107/112 when closing the outer box 105/inner box 110. One or more locks and/or latches can be included to hold covers 107/112 in a closed position. In certain embodiments, the latches provide a water resistant and/or vapor resistant seal. Locks provide security by reducing the likelihood of an unauthorized person obtaining access to the contents the outer box 105 and/or the inner box 110. Examples of locks include camlocks, push button locks, keyed locks, combination locks, digital or radio frequency identification (RFID) locks, or other security mechanism.

In certain embodiments, a mounting system comprises a first mounting board 114*a* and a second mounting board 114*b*. Using two mounting boards 114 facilitates mounting objects 120 on two sides of inner box 110 (e.g., front and back). As shown in the example embodiment of FIG. 3, the inner box 110 is suspended within the outer box 105 such that when system 100 is in a stationary and upright orientation, each mounting surface 116*a*/116*b* is oriented vertically, for example, in order to provide a flat, load-bearing surface to support the one or more objects 120 in an x-y plane. Orienting the mounting surfaces 116*a*/116*b* vertically may allow objects 120 to be loaded in a manner that protects the object 120 from vibrations. For example, when transporting a painting on a stretched canvas by truck, the painting may be better protected from harmful out-of-plane vibrations if hung in a vertical orientation (as opposed to laying the painting flat, which could expose the painting to more out-of-plane vibrations caused by the movement of the truck, which generates a greater proportion of vertical vibration).

In certain embodiments, mounting surface 116 may have a rectangular shape (e.g., a generally four-sided surface in which the sides can all be the same length, such as a square, or different lengths, such as an oblong rectangle, and the corners can be perpendicular, rounded, or beveled). Objects 120 may be secured to a mounting surface 116 using one or more securing mechanisms, such as mounting bolsters 140 described below with respect to FIGS. 10-13.

The properties of a mounting board 114 may be selected to improve the vibration-isolating properties of system 100. Examples of such properties include material, dimensions, mass, stiffness, modulus of elasticity, and positioning within the inner box 110 (e.g., orientation of mounting board 114, spacing between first and second mounting boards 114*a* and 114*b*, spacing between first mounting board 114*a* and front cover 112*a*, spacing between second mounting board 114*b* and back cover 112*b*, etc.).

Certain embodiments dimension each mounting board 114 so that it is large enough to carry one or more objects 120, but not so large as to become cumbersome to transport. Example dimensions of mounting board 114 may be in the range of approximately 12 inches to 120 inches in length, approximately 12 inches to 120 inches in height, and approximately 0.25 inches to 6 inches in width. However, other dimensions could be used, depending on materials used and the object(s) 120 to be carried. Mounting boards 114 may have sufficient mass to ensure the vibration isolators 130 are able to provide sufficient vibration damping. For example, vibration isolators 130 may be tuned to reduce vibrations for a load having a mass within a particular range. The mass of mounting boards 114 may be selected so that the overall mass of the components suspended by the vibration isolators 130 (e.g., the inner box 110 comprising the mounting system loaded with objects 120) satisfies the tuning of the vibration isolators 130. In an embodiment, mounting board 114 comprises a 48"×48" plywood board weighing approximately 30 pounds.

A mounting board 114 may comprise any suitable material, such as wood, aluminum plate, light-weight aluminum honeycomb, plastic, cardboard, etc. In an embodiment, each mounting board 114 comprises a sheet of plywood. Wood may be selected to moderate humidity changes within inner box 110. In certain embodiments, a mounting board 114 may comprise a first material that provides structure and a second material that provides a mounting surface 116. As an example, a mounting board 114 may comprises a wood panel with a mounting surface 116 made of a metallic material and/or a magnetic material, such as a sheet steel plate.

Figure 4:
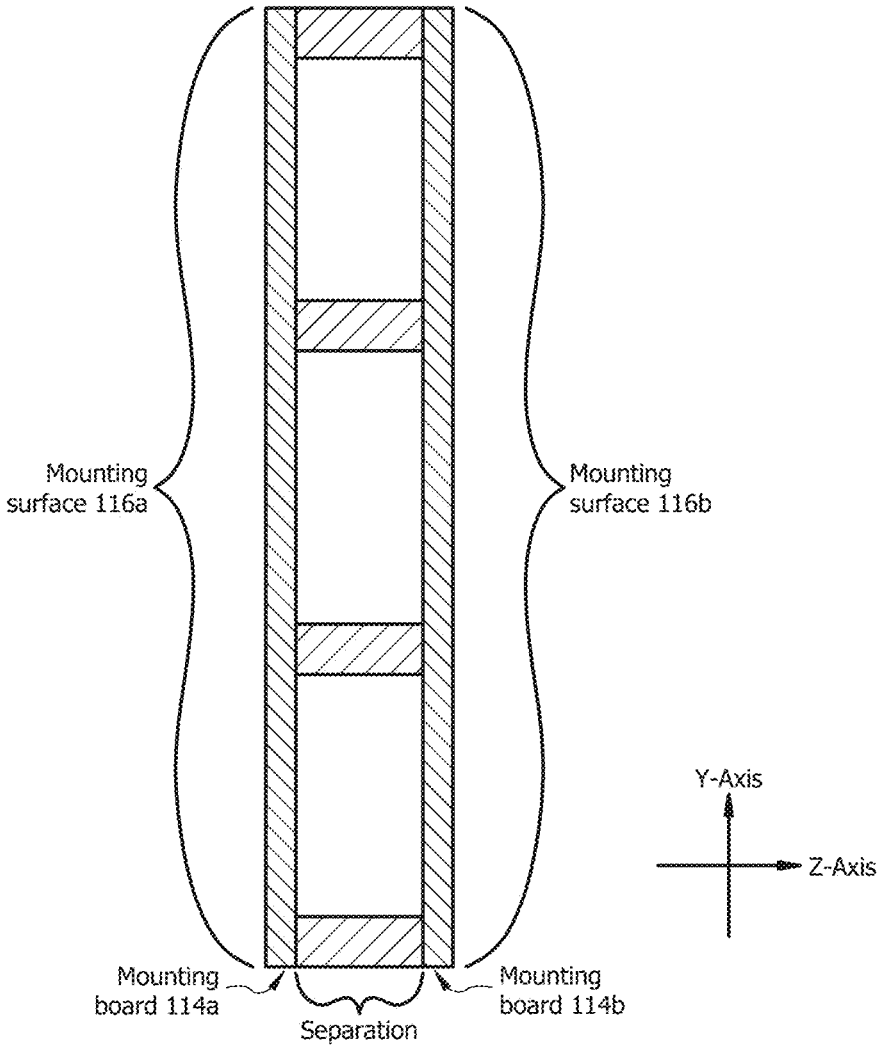
FIG. 4 illustrates an example of first and second mounting boards that may be arranged in the inner box, in accordance with certain embodiments.

FIG. 4 illustrates an example arrangement of mounting boards 114*a* and 114*b*. In the embodiment of FIG. 4, the second mounting board 114*b* is arranged parallel to the first mounting board 114*a* and separated from the first mounting board 114*a* by a distance (the distance labeled "separation" in FIG. 4). In certain embodiments, mounting boards 114*a* and 114*b* may be coupled to interior-facing walls of inner box 110 (e.g., top wall, bottom wall, left wall and/or right wall) in order to maintain the orientation and spacing of mounting boards 114*a* and 114*b*. Optionally, certain embodiments may include support structures (e.g., such as braces, spacers, baffles, slats, or other structures between mounting boards 114*a* and 114*b*) to help maintain the orientation and spacing of mounting boards 114*a* and 114*b*.

Spacing the mounting boards 114*a* and 114*b* by a distance may raise the natural frequency/increase the stiffness of mounting boards 114*a* and 114*b*, which may in turn improve the vibration-isolation properties of system 100. For example, modeling performed on a single plywood mounting board 114*a* with dimensions 60"×48"×⅜" and supported at its corners yielded a natural frequency of 7 Hz. The modeling showed that adding a second mounting board 114*b* of the same type and spacing mounting boards 114*a* and 114*b* apart increased the natural frequency of both mounting boards 114*a* and 114*b* to 31 Hz when spaced by 25 mm (or approximately 1 inch), to 80 Hz when spaced by 89 mm, and to 113 Hz when spaced by 140 mm. Modeling of an aluminum plate mounting board 114 of the same size yielded analogous results (e.g., the natural frequency of a single aluminum plate was 8 Hz, and the natural frequency increased by adding a second aluminum plate spaced apart from the first aluminum plate).

Thus, certain embodiments tune the distance between mounting boards 114*a* and 114*b* to improve vibration-isolation properties of system 100. In an embodiment, a minimum distance between mounting boards 114*a* and 114*b* is at least 25 millimeters, such as at least 50 mm, at least 75 mm, at least 100 mm, at least 125 mm, or at least 150 mm. Additionally, certain embodiments may set a maximum distance between mounting boards 114*a* and 114*b*. As examples, mounting boards 114*a* and 114*b* may be separated by no more than 300 mm, no more than 275 mm, no more than 250 mm, no more than 225 mm, no more than 200 mm, or no more than 175 mm, depending on the embodiment. In certain embodiments, the distance between mounting boards 114*a* and 114*b* yields a natural frequency of the first mounting board 114*a* and the second mounting board 144*b* greater than or equal to a particular frequency, such as at least 30 Hz, 40 Hz, 50 Hz, 60 Hz, 70 Hz, 80 Hz, 90 Hz, 100 Hz, 110 Hz, 120 Hz, or other suitable frequency. Certain embodiments select the distance between mounting boards 114*a* and 114*b* to achieve a stiffness that provides a first natural frequency of the inner box clearly above the range of frequencies to be attenuated. As an example, to attenuate frequencies in the range of 10-50 Hz, the first natural frequency of the inner box 110 (with art) may be tuned to be above 100 Hz (e.g., certain embodiments select the distance between mounting boards 114*a* and 114*b* to yield a natural frequency of the first mounting board 114*a* and the second mounting board 144*b* in the range of 100 Hz to 150 Hz). Although FIG. 4 describes embodiments that use separation of mounting boards 114*a* and 114*b* to add stiffness to system 100, other embodiments may add sufficient stiffness through the use of outer box 105 and/or inner box 110, without requiring separate mounting boards 114*a* and 114*b* (or without requiring mounting boards 114*a* and 114*b* to be separated by a particular distance in order to yield a suitable stiffness). As an example, in certain embodiments, covers 112*a* and 112*b* may add sufficient stiffness to system 100.

Certain embodiments further improve vibration-isolation properties of system 100 by optimizing the placement and orientation of each vibration isolator 130 relative to the outer box 105, the inner box 110, and/or other vibration isolators 130. In general, vibration isolators 130 may be arranged such that the inner box 110 may be made self-centering within the outer box 105. For example, vibration isolators 130 can be configured to minimize the extent to which the inner box 110 carrying object(s) 120 moves from its initial position in response to vibration and/or shock impinged on the outer box 105.

The initial position of the inner box 110 can be referred to as point (0, 0, 0) relative to the x-axis, y-axis, and z-axis. Return of the inner box 110 to the initial position (0, 0, 0) can be optimized by arranging vibration isolators 130 to oppose one another. For example, the embodiment of FIG. 1 illustrates four vibration isolators 130. Each vibration isolator 130 is focused on the CG. By focusing on the CG, the various vibration modes are decoupled, that is to say, vertical vibration on the outer box 105 causes the inner box 110 to move only in the vertical direction, not laterally, not twisting. Optionally, certain embodiments may arrange some or all of the vibration isolators 130 in diagonally opposed pairs. As an example, in FIG. 1, the first pair comprises vibration isolator 130*a* diagonally opposed to vibration isolator 130*d*, and the second pair comprises vibration isolator 130*b* diagonally opposed to vibration isolator 130*c*. A movement that pushes vibration isolator 130*a* would pull the opposing vibration isolator 130*d* such that when vibration isolator 130*a* undergoes compression, the opposing vibration isolator 130*d* undergoes tension, and vice versa. Similarly, when vibration isolator 130*b* undergoes compression, the opposing vibration isolator 130*c* undergoes tension, and vice versa. Thus, opposing vibration isolators 130 keep the net effect of the movement as close to neutral as possible.

In certain embodiments, the suspension system may be configured such that each vibration isolator 130 is in a state of slight compression or tension when the inner box 110 is in its initial position (0, 0, 0). Thus, the suspension system can respond to movements that cause one vibration isolator 130 to undergo increased compression without immediately causing the opposing vibration isolator 130 to undergo tension.

As described above, the vibration isolators allow for some amount of movement and re-centering of the inner box 110. While this movement helps to reduce vibrations when system 100 is in transit, the movement may make it difficult to load objects 120 in system 100 prior to transit or to unload objects 120 from system 100 once system 100 has reached its destination. To address this, certain embodiments of system 100 further comprise a loading mechanism adapted to hold the inner box 110 (including the mounting system) steady when in a first mode, such as when a technician is loading or unloading objects 120. For example, the loading mechanism may cause the vibration isolators 130 to disengage (e.g., by stiffening the vibration isolators 130, disconnecting the vibration isolators 130, and/or connecting a structure that steadies the inner box 110). The loading mechanism is further adapted to engage the plurality of vibration isolators 130 when in a second mode, such as when system 100 is in transit and would benefit from vibration isolation. Certain embodiments further comprise a stopper that prevents at least one of the outer box 105 or the inner box 110 from closing or locking when the loading mechanism is in the first mode. By preventing closing and/or locking of one or both boxes, a technician may be alerted to a problem (i.e., that system 100 is not ready to be transported because the vibration isolators 130 have not yet been engaged).

Figure 5A:
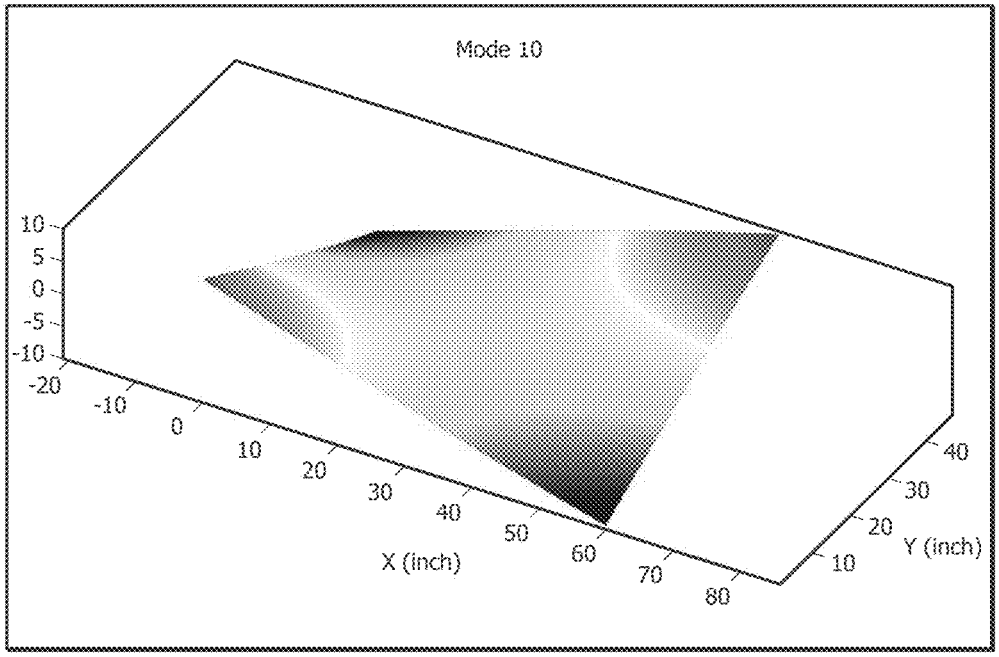
FIGS. 5A, 5B, and 5C each illustrate an example of a modal response, which certain embodiments use in determining attachment points for attaching vibration isolators to the inner box.

The attachment points of vibration isolators 130 to the inner box 110 affect the vibration-isolation properties, as further explained with respect to FIGS. 5A-7C. For example, FIGS. 5A-5C illustrate examples of modeling performed to analyze how the attachment points affect vibration-isolation properties. As further explained below, the modeling led to the following conclusions. First, when vibration isolators 130 are connected at the corners of a rectangular plate, any vibration passing through the vibration isolators 130 is very capable of exciting many plate modes, including the fundamental mode. Thus, connecting the vibration isolators 130 at the corners of the rectangular plate is not optimal. Second, overall the fewest natural frequencies are excited when the vibration isolators 130 are connected at the center of the plate edges. Similar conclusions are drawn independent of the number of modes evaluated. Third, in general, avoiding connecting vibration isolator 130 within approximately 10-20% of the length dimension from each corner may in turn avoid exciting plate modes and may therefore improve vibration-isolation performance. Offsetting the vibration isolators 130 from the center of the plate edges may increase stability. For example, offsetting the vibration isolators 130 from the center of the plate edges may increase the stance on vibration isolators 130 and may reduce the maximum force on any single vibration isolator 130 compared to an alternative embodiment that positions vibration isolators 130 only at the center of the plate edges (the latter may cause one of the vibration isolators 130 to carry more than the full weight of the system). For simplicity, the analysis assumes that all vibration isolator 130 connections to the outer box 105 are equally good.

For purposes of the modeling, an outer box 105 was exposed to various vibration models in order to analyze the effect on an inner plate to be isolated from vibration. Each vibration model included an x-parameter (indicating a number of nodes in the horizontal/x-direction), a y-parameter (indicating a number of nodes in the vertically-direction), and an s-parameter (indicating a mode shape parameter: elliptic paraboloid, hyperbolic paraboloid, or beam mode). The modeling included the following variations:

TABLE 1

| Model Number | x-parameter | y-parameter | s-parameter |
|---|---|---|---|
| 1 | 1 | 1 | Beam |
| 2 | 2 | 0 | Hyperbolic Paraboloid |
| 3 | 2 | 0 | Elliptic Paraboloid |
| 4 | 1 | 2 | Beam |

TABLE 1-continued

| Model Number | x-parameter | y-parameter | s-parameter |
|---|---|---|---|
| 5 | 2 | 1 | Beam |
| 6 | 3 | 0 | Beam |
| 7 | 0 | 3 | Beam |
| 8 | 2 | 2 | Beam |
| 9 | 3 | 1 | Hyperbolic Paraboloid |
| 10 | 3 | 1 | Elliptic Paraboloid |
| 11 | 2 | 3 | Beam |
| 12 | 3 | 2 | Beam |
| 13 | 4 | 0 | Hyperbolic Paraboloid |
| 14 | 4 | 0 | Elliptic Paraboloid |
| 15 | 1 | 4 | Beam |
| 16 | 4 | 1 | Beam |
| 17 | 3 | 3 | Beam |
| 18 | 4 | 2 | Hyperbolic Paraboloid |
| 19 | 4 | 2 | Elliptic Paraboloid |
| 20 | 0 | 5 | Beam |
| 21 | 5 | 0 | Beam |
| 22 | 5 | 1 | Hyperbolic Paraboloid |
| 23 | 5 | 1 | Elliptic Paraboloid |
| 24 | 4 | 3 | Beam |
| 25 | 3 | 4 | Beam |

Figure 5B:
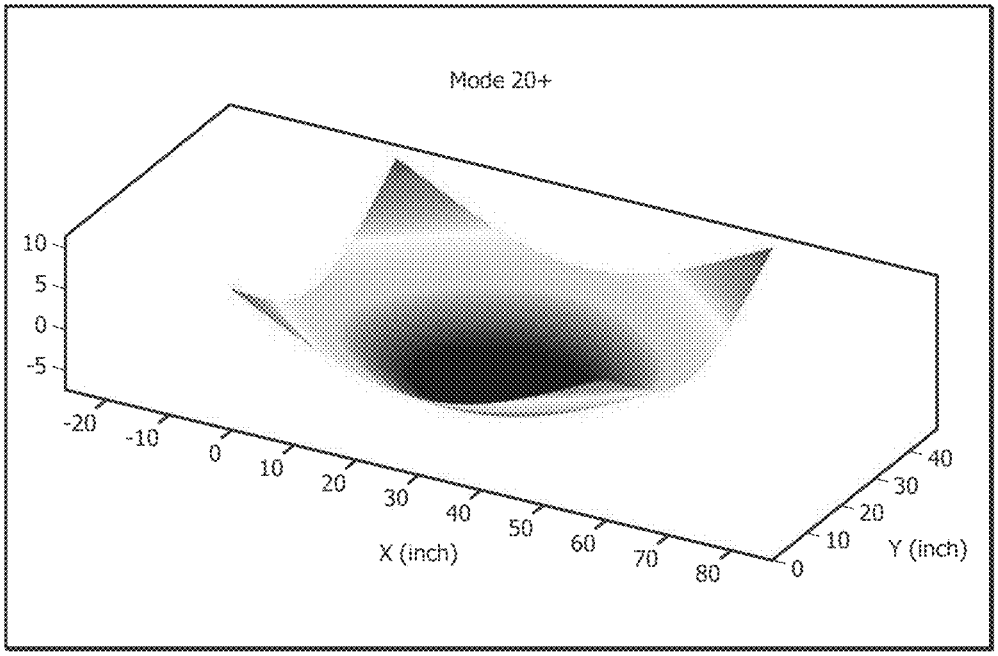
Figure 5C:
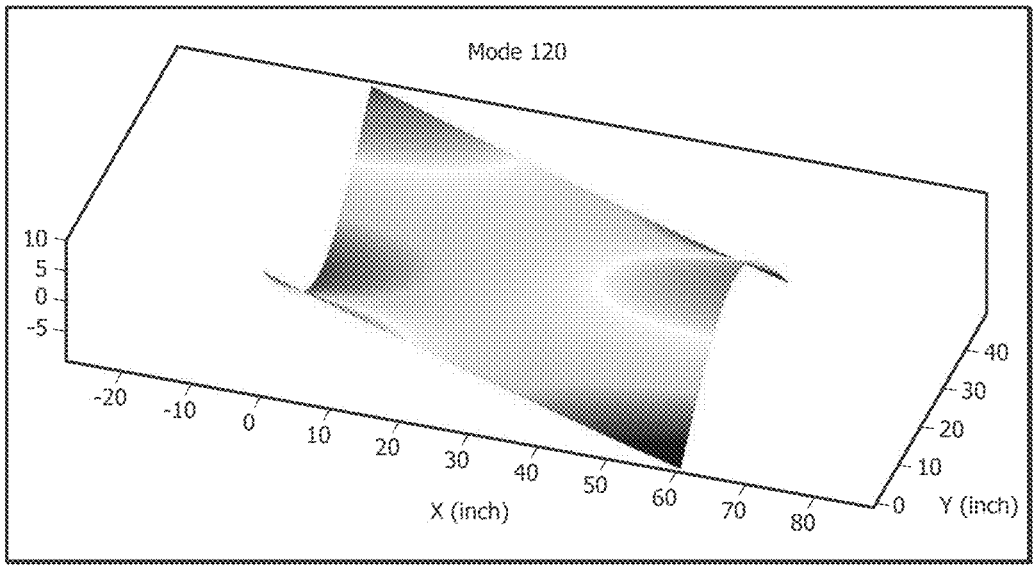

Without proper vibration isolation, exposing the outer box 105 to vibration causes the inner plate to respond in a manner somewhat analogous to a guitar string that has been plucked. That is, the inner plate will vibrate such that at a particular moment, some portion of the inner plate may move outward while another portion of the inner plate may move inward. FIGS. 5A-5C illustrate examples of three-dimensional views of such vibrations. In particular, FIG. 5A illustrates an example of the vibration properties for model 1 (one x-axis node, one y-axis node, beam shape). FIG. 5B illustrates an example of the vibration properties for model 3 (two x-axis nodes, zero y-axis nodes, elliptic paraboloid shape). FIG. 5C illustrates an example of the vibration properties for model 4 (one x-axis node, two y-axis nodes, beam shape). As can be seen, the models illustrated in FIGS. 5A-5C generally exhibited a relatively high amount of movement at the corners of the inner plate.

Figure 6A:
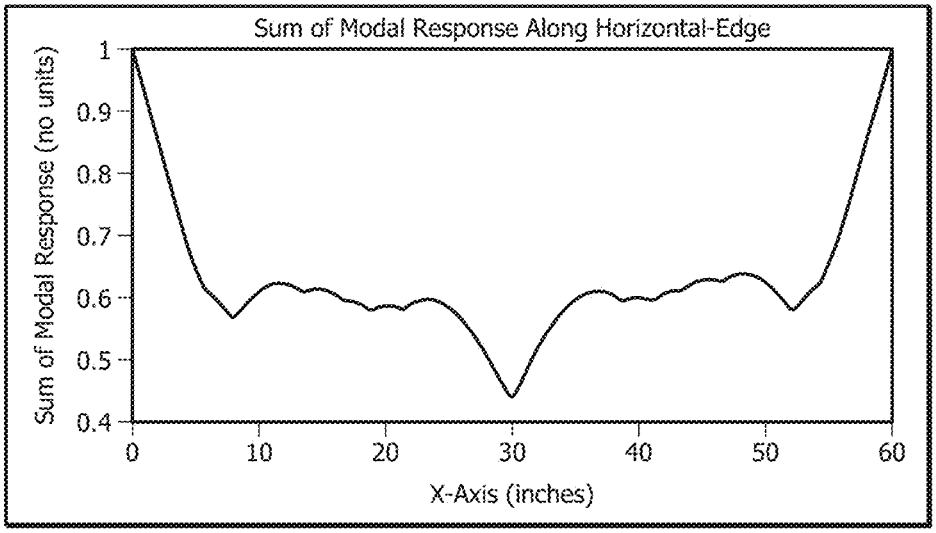
FIGS. 6A-6F illustrate examples of sums of modal responses, which certain embodiments use in determining attachment points for attaching vibration isolators to the inner box.

The observation that the corners of the inner plate exhibited a relatively high amount of movement held true for the other models, as indicated by FIGS. 6A-6F. For example, FIG. 6A illustrates a graph in which the x-axis of the graph illustrates the horizontal dimension of the inner plate, with 0 inches corresponding to the left-most side of the horizontal dimension (i.e., a left corner), 30 inches corresponding to the middle of the horizontal dimension, and 60 inches corresponding to the right-most side of the horizontal dimension (i.e., a right corner). The y-axis of the graph illustrates the modal response associated with the sum of the 25 models described in Table 1 above. As can be seen, the modal response is greatest at the corners (approximately 1). Note that the curves are normalized so that the maximum value is exactly 1. This was done so that modal response curves can be easily compared (for example comparing the curves for the first five modes to the curves for the first twenty-five modes). The modal response steadily drops such that the modal response for the region approximately 10% of the plate length away from either corner (e.g., the region from 6 inches to 54 inches in the example) falls below approximately 0.6, with the lowest point in the middle of the horizontal dimension (at 30 inches).

Figure 6B:
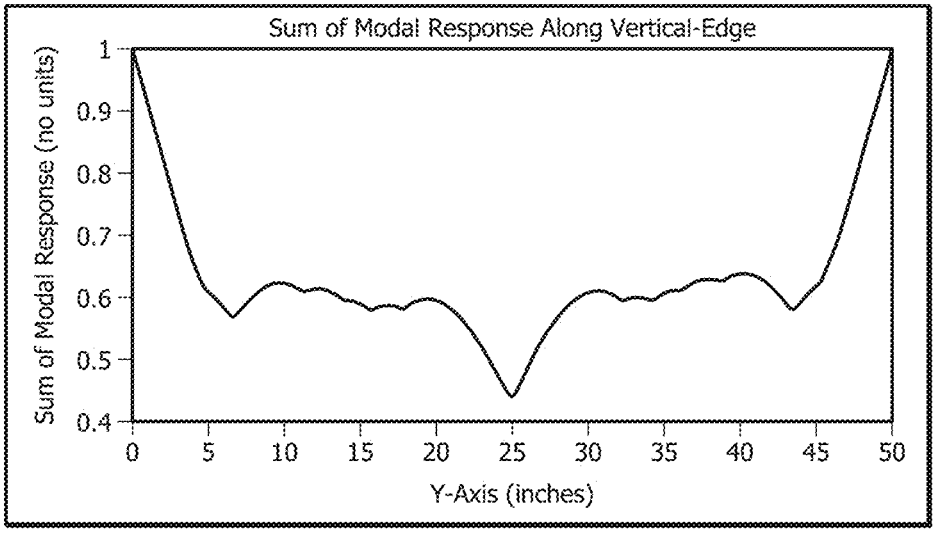

Similarly, FIG. 6B illustrates a graph in which the x-axis of the graph illustrates the vertical dimension of the inner plate, with 0 inches corresponding to the bottom side of the vertical dimension (i.e., a bottom corner), 25 inches corresponding to the middle of the vertical dimension, and 50 inches corresponding to the top of the vertical dimension (i.e., a top corner). The y-axis of the graph illustrates the modal response associated with the sum of the 25 models described in Table 1 above. As can be seen, the modal response is greatest at the corners (approximately 1). Note that the curves are normalized so that the maximum value is exactly 1. This was done so that modal response curves can be easily compared (for example comparing the curves for the first five modes to the curves for the first twenty-five modes). The modal response steadily drops such that the modal response for the region approximately 10% of the plate length away from either corner (e.g., the region from 5 inches to 45 inches in the example) falls below approximately 0.6, with the lowest point near the middle of the vertical dimension (at approximately 24 inches).

Figure 6C:
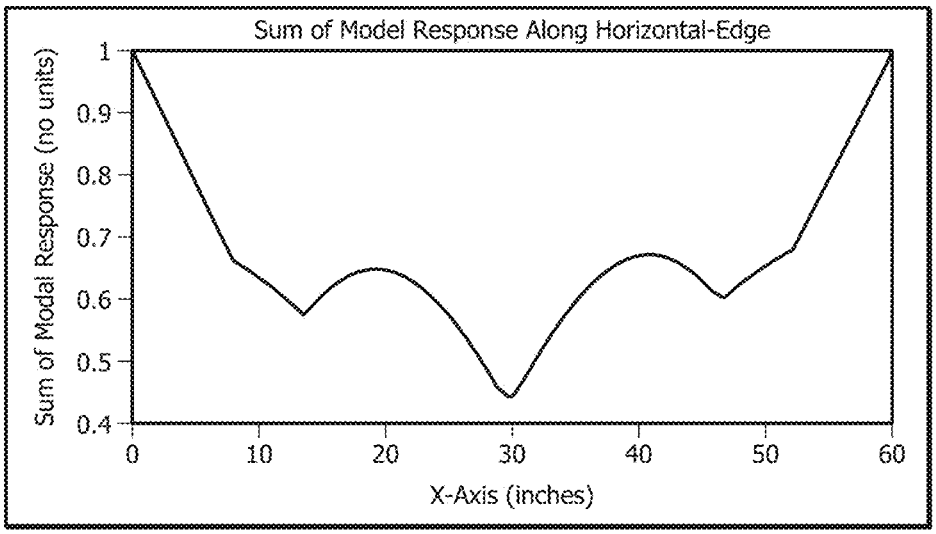
Figure 6D:
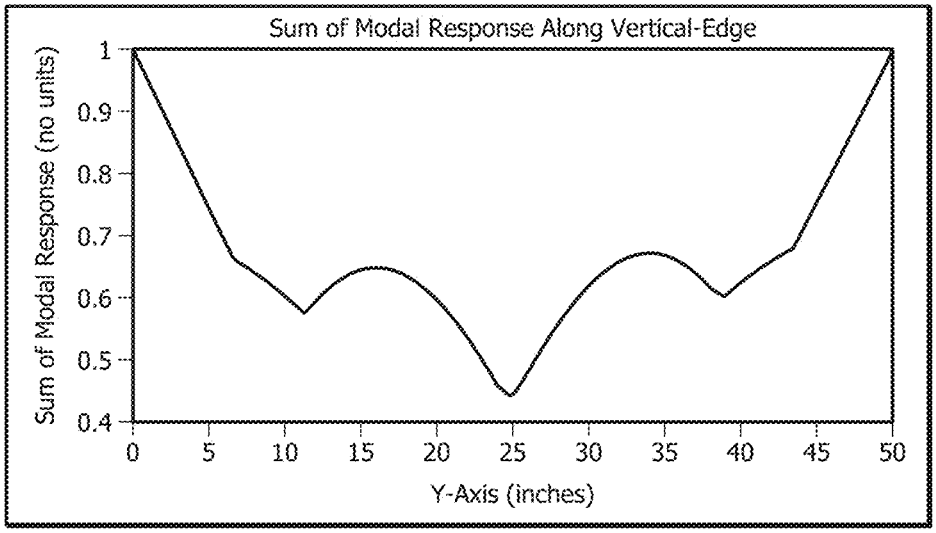
Figure 6E:
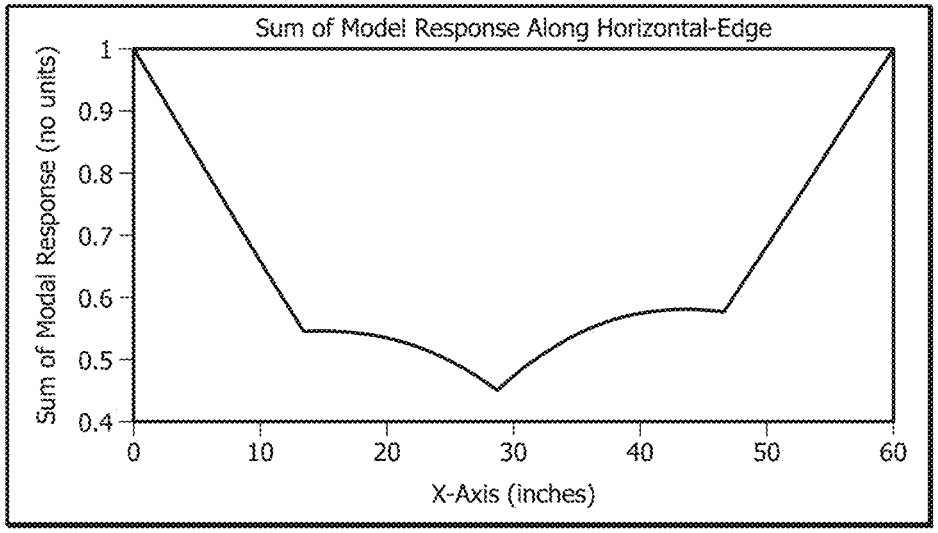
Figure 6F:
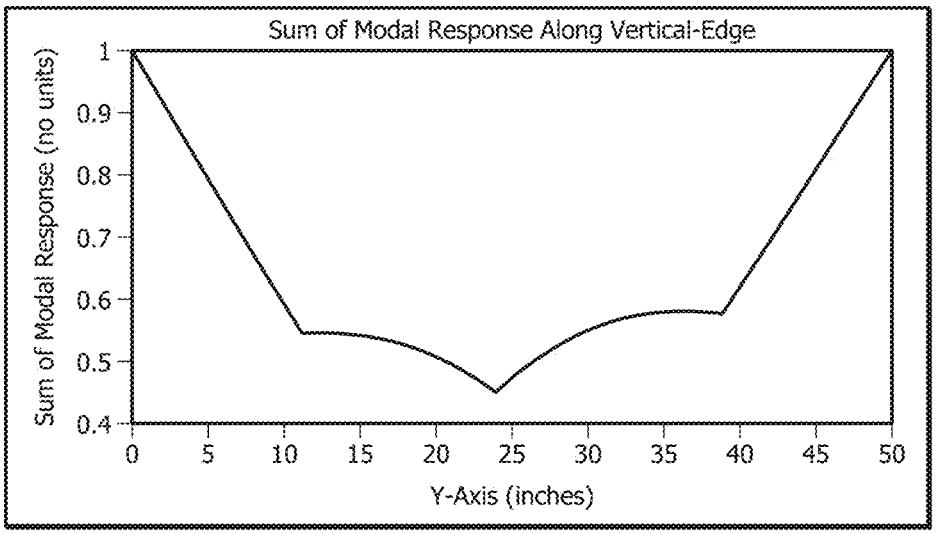

FIGS. 6C and 6E are analogous to FIG. 6A, however, the y-axis of the graph in FIG. 6C illustrates the modal response associated with the sum of the first 10 models, and the y-axis of the graph in FIG. 6E illustrates the modal response associated with the sum of the first 5 models. FIGS. 6D and 6F are analogous to FIG. 6B, however, the y-axis of the graph in FIG. 6D illustrates the modal response associated with the sum of the first 10 models, and the y-axis of the graph in FIG. 6F illustrates the modal response associated with the sum of the first 5 models. As can be seen, for both the horizontal and vertical dimensions, the modal response remains highest at the corners and lowest near the middle.

Note that in order to sum the models as described with respect to FIGS. 6A-F, all modes were scaled to maximum amplitude of unity. The mode shapes were replaced with their absolute value. Amplitudes only along the x- and y-axes of the modes were used. The amplitudes for the first n mode edges were added together. The total amplitude was scaled to a maximum of unity.

Certain embodiments select the attachment points for vibration isolators 130 based on the modal response. For example, in certain embodiments, each of the plurality of vibration isolators 130 attaches to the inner box 110 at a respective attachment point, and each attachment point avoids locations for which a modal response associated with the location exceeds a threshold. In other words, certain embodiments select the attachment points for vibration isolators 130 such that the modal response is below a threshold. Continuing with the example of FIGS. 6A and 6B, if the threshold was set as 0.6, the attachment points would avoid the areas near the corners. That is, the attachment points would avoid the areas located in approximately the 0 to 6 inch and the 54 to 60 inch regions in the horizontal dimension, and the attachment points would avoid the areas located in approximately the 0 to 5 inch and 45 to 50 inch regions in the vertical direction.

FIGS. 7A-C illustrate examples of attachment points P for attaching vibration isolators 130 relative to an x-y plane of the inner box 110. Each of the plurality of vibration isolators 130 attaches to the inner box 110 at a respective attachment point P. Each attachment point P avoids locations within a distance of an inner box corner nearest the respective attachment point. In other words, attachment points P avoid areas with a high modal response (i.e., areas near the corners, as explained above with reference to FIGS. 5A-5C and 6A-6F). In certain embodiments, attachment points P may be substantially centered with respect to the depth/z-dimension of the inner box 110 (see e.g., FIGS. 1-3).

FIG. 7A illustrates an embodiment comprising four vibration isolators 130, each vibration isolator 130 focused on CG. A first vibration isolator 130 attaches at attachment point P1, a second vibration isolator 130 attaches at attachment point P2, a third vibration isolator 130 attaches at attachment point P3, and a fourth vibration isolator 130 attaches at attachment point P4. In FIG. 7A, the points of attachment are positioned along horizontal surfaces (top and bottom surfaces) of the inner box 110. While the attachment points P avoid the areas with a high modal response (i.e., areas within a certain distance of the corners), P1 is nearest the top-left corner, P2 is nearest the top-right corner, P3 is nearest the bottom-left corner, and P4 is nearest the bottom-right corner. In certain embodiments, the four vibration isolators may be arranged in two pairs of diagonally opposed vibration isolators 130. Thus, as illustrated, the first and fourth vibration isolators 130 form a first pair of vibration isolators 130 diagonally opposed through the center of gravity of the inner box 110, and the second and third vibration isolators form a second pair of vibration isolators 130 diagonally opposed through the center of gravity of the inner box 110. FIG. 7A illustrates "x1" as the length dimension of the inner box 110 and "x2" as a distance from the top-left corner to be avoided by the nearest attachment point (i.e., attachment point P1 in the illustration). In certain embodiments, the distance x2 comprises at least 10% of a horizontal dimension (x1) of the inner box 110.

FIG. 7B illustrates an embodiment comprising four vibration isolators 130, each vibration isolator 130 focused on the CG. A first vibration isolator 130 attaches at attachment point P1, a second vibration isolator 130 attaches at attachment point P2, a third vibration isolator 130 attaches at attachment point P3, and a fourth vibration isolator 130 attaches at attachment point P4. In FIG. 7B, the points of attachment are positioned along vertical surfaces (left and right surfaces) of the inner box 110. While the attachment points P avoid the areas with a high modal response (i.e., areas within a certain distance of the corners), P1 is nearest the top-left corner, P2 is nearest the top-right corner, P3 is nearest the bottom-left corner, and P4 is nearest the bottom-right corner. In certain embodiments, the four vibration isolators may be arranged in two pairs of diagonally opposed vibration isolators 130. Thus, as illustrated, the first and fourth vibration isolators 130 form a first pair of vibration isolators 130 diagonally opposed through the center of gravity of the inner box 110, and the second and third vibration isolators form a second pair of vibration isolators 130 diagonally opposed through the center of gravity of the inner box 110. FIG. 7B illustrates "y1" as the height dimension of the inner box 110 and "y2" as a distance from the top-left corner to be avoided by the nearest attachment point (i.e., attachment point P1 in the illustration). In certain embodiments, the distance y2 comprises at least 10% of a vertical dimension (y1) of the inner box 110.

FIG. 7C illustrates an alternate embodiment that combines the two pairs of vibration isolators 130 described with respect to FIG. 7A (vibration isolators 130 that attach to the top and bottom surfaces of the inner box 110) and the two pairs of vibration isolators 130 described with respect to FIG. 7B (vibration isolators 130 that attach to the left and right surfaces of the inner box 110). Like the vibration isolators 130 illustrated in FIGS. 7A and 7B, the vibration isolators 130 illustrated in FIG. 7C avoid attachment points with a high modal response (i.e., areas within a certain distance of the corners of the inner box 110).

System 100 may include any suitable number of vibration isolators 130, depending on the embodiment (e.g., one vibration isolator 130, two vibration isolators 130, three vibration isolators 130, four vibration isolators 130, etc.). Certain embodiments may use four vibration isolators (e.g., two pairs of diagonally opposed isolators, such as shown in FIG. 7A or 7B) in order to sufficiently stabilize the inner box 110 in the x-, y-, and z-dimensions.

As described above, certain embodiments may focus one or more vibration isolators 130 on the center of gravity of the inner box 110. Orienting the vibration isolators 130 toward the center of gravity may improve the vibration-isolation properties of the vibration isolators 130. In certain embodiments, the center of gravity of the inner box 110 may be determined based on the components of the inner box 110 in a closed arrangement, including its covers 112*a* and 112*b* and the mounting system within the inner box 110 (e.g., mounting boards 114). As further described below with respect to FIGS. 10-16B, objects 120 may be loaded onto the mounting system in a manner that maintains balance around the center of gravity of the inner box 110. Thus, the location of the center of gravity of the inner box 110 may be substantially the same regardless of whether the inner box 110 has or has not been loaded with objects 120 such that loading the inner box 110 with objects 120 does not impede the tuning of the vibration isolators 130.

In certain embodiments, the plurality of vibration isolators 130 comprises at least one multi-stage vibration isolator. A multi-stage vibration isolator is adapted to provide at least a first mode of vibration isolation in response to a first vibration amplitude and to provide a second mode of vibration isolation in response to a second vibration amplitude. For example, in certain embodiments, the second vibration amplitude is greater than the first vibration amplitude (e.g., the first vibration amplitude yields lower level vibration and the second vibration amplitude yields greater level vibration). In response to the greater level vibration, the second mode of vibration isolation is more rigid than the first mode of vibration isolation. Optionally, the multi-stage vibration isolator may provide additional modes of vibration isolation, such as a third mode of vibration isolation in response to a third vibration amplitude that is greater than the first vibration amplitude and the second vibration amplitude.

Figure 8:
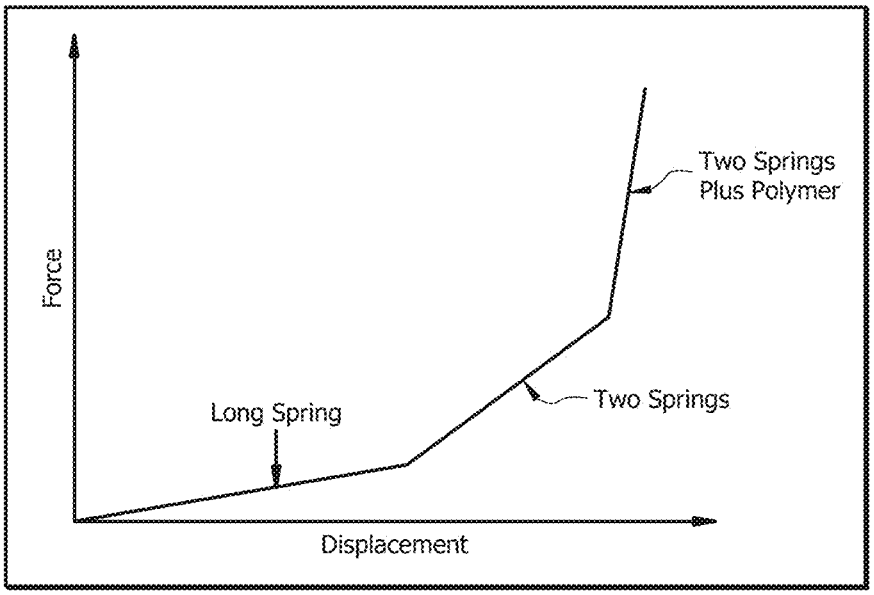
FIG. 8 illustrates an example of force-displacement behavior of a multi-stage vibration isolator, in accordance with certain embodiments.

FIG. 8 illustrates an example of force-displacement properties of a multi-stage vibration isolator. A first low amplitude vibration, that is, low displacements, cause the isolator to operate on the first, "long spring" portion of the force/displacement curve of FIG. 8 in order to provide a first mode of vibration isolation. A second greater amplitude vibration, that is, greater displacements, cause the isolator to operate on the second, "two spring" portion of the force/displacement curve of FIG. 8 in order to provide a second mode of vibration isolation. For example, the second mode of vibration isolation may engage the long spring used in the first mode of vibration isolation and a second, nested spring wound in a direction opposite the first spring. Winding the springs with opposite hand may prevent tangling, however, other embodiments may use other techniques to prevent tangling (other embodiments might not wind the springs with opposite hand). The second mode of vibration isolation provides more rigidity than the first mode of vibration isolation (e.g., the second mode of vibration isolation responds to displacement with greater force).

In certain embodiments, a third vibration amplitude causes greater displacement that may trigger a third mode of vibration isolation. In the example of FIG. 8, the third mode of vibration isolation engages both of the springs and a third vibration isolation mechanism (illustrated as the polymer, such as rubber, in FIG. 8). In this manner, the third mode of vibration isolation provides more rigidity than the first and second modes of vibration isolation (e.g., the third mode of vibration isolation responds to displacement with greater force). For example, the third vibration isolation mechanism may act as a jounce bumper. Additionally, the third mode of vibration isolation may damp a rebound associated with the response to a vibration amplitude (e.g., first, second, and/or third vibration amplitude). Damping the rebound may allow the inner box 110 to return/self-center to its initial position (0, 0, 0) gradually, rather than abruptly.

The multi-stage stiffness described above 1) allows very low stiffness for good isolation of low amplitude, low frequency vibration, 2) prevents the occasional high amplitude vibration from causing the inner box 110 to collide with the outer box 105, and 3) prevents the system from going solid (because a solid system would be capable of transmitting very high frequencies).

Figure 9:
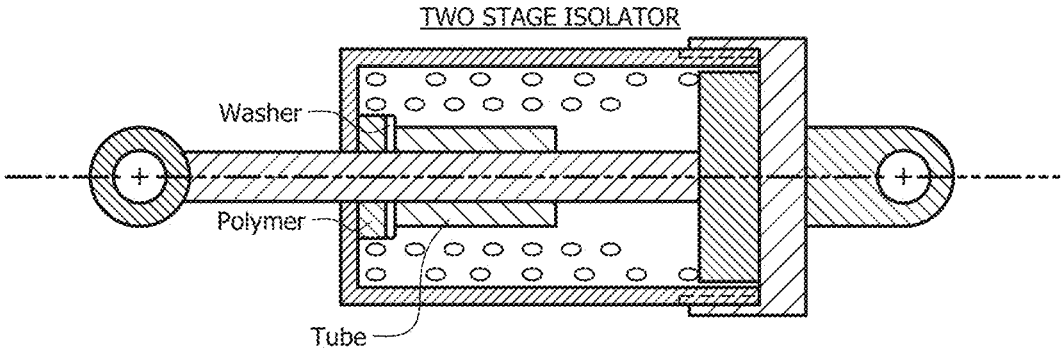
FIG. 9 illustrates an example of a multi-stage vibration isolator, in accordance with certain embodiments.

FIG. 9 illustrates an example of a multi-stage vibration isolator, in accordance with certain embodiments. The multi-stage vibration isolator comprises a tube (such as a steel tube) adapted to house nested springs. The nested springs may comprise a first spring and a second spring wound with opposite hand. For example, the first spring may be wound clockwise, and the second spring may be wound counter-clockwise, or vice versa. Winding the springs with opposite hand may prevent tangling, however, other embodiments may use other techniques to prevent tangling (other embodiments might not wind the springs with opposite hand). In certain embodiments, the first spring engages in response to a first vibration amplitude to provide a first mode of vibration isolation. Both springs engage in response to a second vibration amplitude that is greater than the first vibration amplitude in order to provide a second, more rigid mode of vibration isolation.

In certain embodiments, the multi-stage vibration isolator further comprises a third vibration isolation mechanism (illustrated as the polymer in FIG. 8). In certain embodiments, the polymer may comprise rubber. The third vibration isolation mechanism facilitates a third mode of vibration isolation. The third mode of vibration isolation provides more rigidity than the first and second modes of vibration isolation (e.g., the third mode of vibration isolation responds to displacement with greater force). Additionally, in certain embodiments, the third mode of vibration isolation may damp a rebound associated with the response to a vibration amplitude (e.g., first, second, and/or third vibration amplitude).

In certain embodiments, the multi-stage vibration isolator comprises a washer, such as a steel washer. The washer may provide a better wear surface than the polymer and thus may be positioned to protect the polymer from wear.

FIGS. 10-13 illustrate examples of mounting bolsters 140, in accordance with certain embodiments. In general, a mounting bolster 140 is adapted to facilitate mounting an object 120 onto a mounting surface 116 of mounting board 114. For example, FIG. 10 illustrates an example of a mounting bolster 140 having a corner shape. Corner-shaped mounting bolsters 140 may be well-suited to mount certain objects 120, such as one or more paintings. In certain embodiments, each painting may be mounted to mounting surface 116 using a set of four corner-shaped mounting bolsters 140 (one mounting bolster 140 per top-left, top-right, bottom-left, and bottom-right corner of the painting). Other embodiments may use mounting bolsters 140 having different shapes (e.g., linear, arc, wedge, custom shape to accommodate an irregularly shaped object 120, etc.). Different types of mounting bolsters 140 may be used together. As an example, a linear-shaped mounting corner 140 could be positioned at the bottom of a painting to act as a ledge for the painting, and two corner-shaped mounting bolsters 140 could be placed at the top corners of the painting.

The mounting bolster 140 illustrated in FIG. 10 comprises a structure 142 that defines the general shape of the mounting bolster 140. As an example, structure 142 may be a relatively rigid structure having a corner shape (e.g., one support surface in the x-y plane, one support surface in the x-z plane, and one support surface in the y-z plane). Object-facing surfaces of structure 142 may comprise padding, such as soft foam, or other suitable material to cushion and/or grip object 120. Padding may prevent scratching, denting, or otherwise damaging object 120 as object 120 is being loaded/unloaded or is in transit. Padding may be selected to provide some grip that helps to hold object 120 in place within mounting bolster 140 and prevents object 120 from slipping out of mounting bolster 140. In certain embodiments, the material comprises a foam material, such as a foam material shaped into a corner shape using a waterjet cutting technique.

Figure 12:
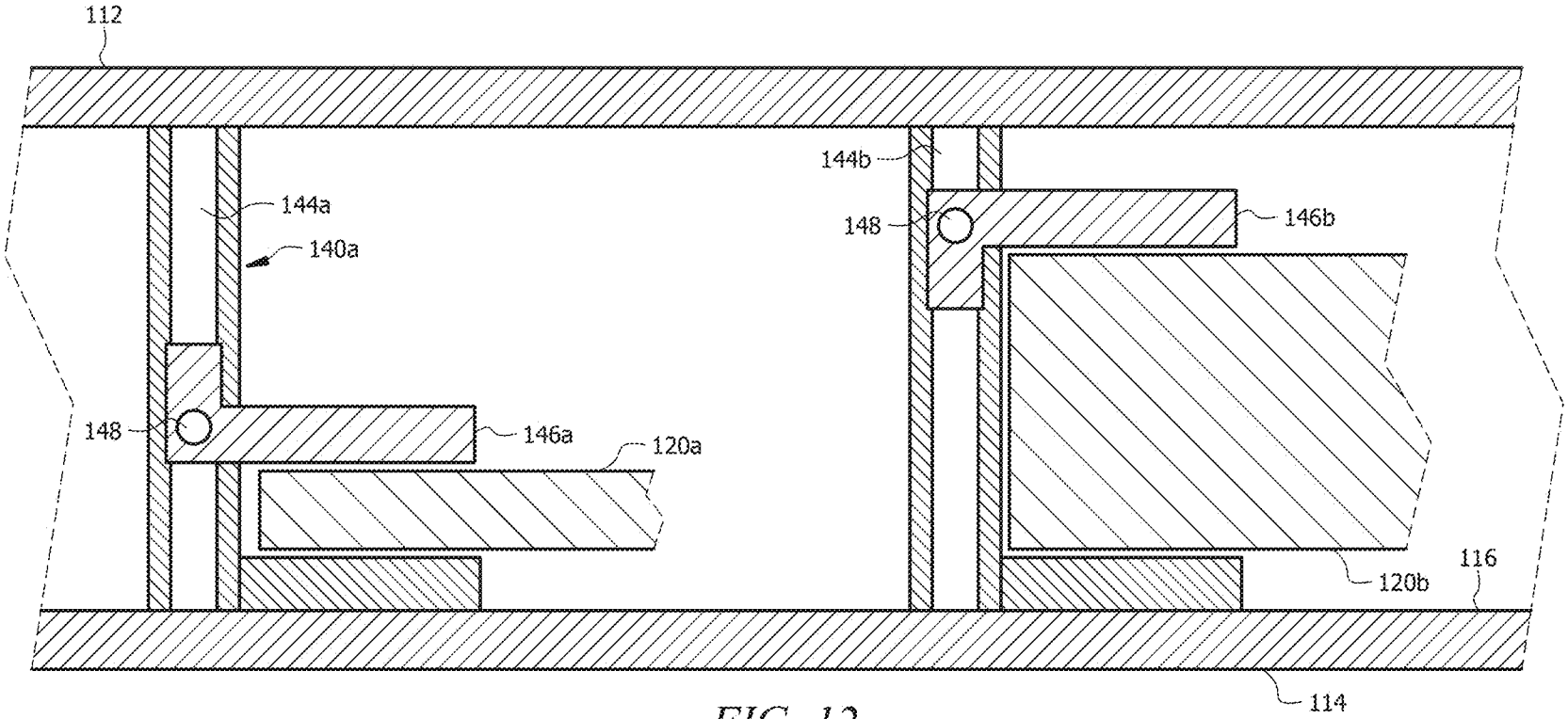
Figure 13:
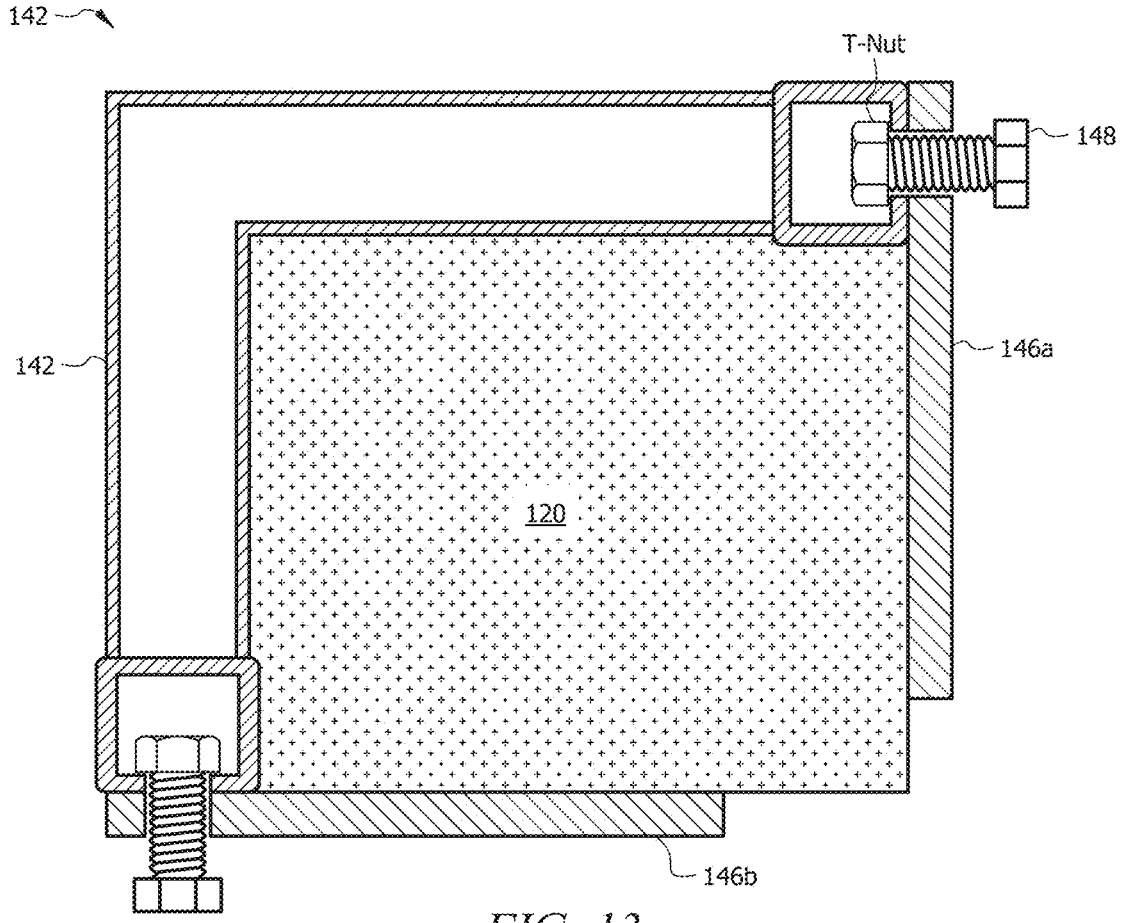

As shown in the embodiments of FIGS. 10, 12, and 13, for example, the mounting bolster 140 may further comprise a pad 146 adapted to secure an object 120 to the mounting bolster 140 when the pad 146 is in a first position and to release the object 120 from the mounting bolster 140 when the pad 146 is in a second position. As an example, in the orientation shown in FIG. 12, pad 146 may slide downward to secure an object 120, and pad 146 may slide upward to release the object 120. As can be seen in FIG. 12, the position of pad 146 that secures the object 120 and the position of pad 146 that releases the object 120 depends on the size of object 120. For example, pad **146*a* slides further downward to secure the smaller object 120*a* on the left side of FIG. 12 than pad 146*b* slides to secure the larger object 120*b* on the right side of FIG. 12**.

To facilitate the sliding of pad 146, pad 146 may comprise one or more retaining screws 148 that allow for coupling pad 146 to one or more channels 144 formed in one or more sides of structure 142. In certain embodiments, the pad 146 is adapted to be locked into a position by turning the retaining screw 148 such that the retaining screw 148 securely engages channel 144. Similarly, the pad 146 is adapted to be released from a position by turning the retaining screw 148 such that the retaining screw 148 disengages from channel 144. In certain embodiments, channel 144 may comprise a T-slot channel, and retaining screw 148 engages/disengages a T-nut positioned in the channel 144. In certain embodiments, pad 146 may be designed to be secured and released using a torque wrench. Using a torque wrench may help a technician to confirm that pad 146 is locked securely in place. As an example, all fasteners (e.g., retaining screws 148) could use the same torque (which could be an adjustable/calibrated/pre-set torque value), and the torque wrench may make a clicking sound to indicate when the fasteners are locked securely in place. In an embodiment, the torque wrench is a pre-set "T" handle slip type torque wrench that automatically releases and resets upon reaching the pre-set torque value.

In certain embodiments, pad 146 may comprise an L-plate with a tang that fits within the channel 144 (e.g., T-slot channel) to keep the plate in an orientation suitable to hold object 120 in place. The pad 146 can be inverted to accommodate the extremes of art frame sizes. For example, FIG. 12 illustrates the pad **146*a* with the tang facing away from mounting board 114 in order to accommodate a smaller object 120*a* and pad 146*b* with the tang facing toward mounting board 114 in order to accommodate a larger object 120*b***.

In certain embodiments, a mounting bolster 140 may have a double-layer design. As an example, the corner-shaped mounting bolster 140 illustrated in FIG. 10 could be modified to have a double layer design comprising an outer layer (e.g., a relatively rigid corner structure) and an inner layer (e.g., the corner-shaped structure 142) arranged in the same orientation such that the inner layer generally nests within the outer layer. The outer layer may couple to the inner layer via a plurality of wire rope isolators (e.g., each wire rope isolator may couple between an inner surface of the outer layer and an outer surface of the inner layer). On the other hand, as shown in FIG. 10, certain embodiments use mounting bolsters 140 that do not include any wire rope isolators in order to avoid introducing points of mobility that could create harmonics or otherwise interfere with the proper functioning of vibration isolators 130 that suspend the inner box 110 in the outer box 105.

In certain embodiments, a mounting bolster 140 comprises a positioning mechanism. The positioning mechanism allows for moving object 120 to any suitable position on mounting surface 116. In certain embodiments, the positioning mechanism allows for moving mounting bolster 140 horizontally (in the direction of the x-axis), vertically (in the direction of the y-axis), and diagonally (in any other direction in the x-y plane). For example, instead of using racks, channels, or similar structures that may constrain the movement of mounting bolster 140, the positioning mechanism may comprise one or more magnets, Velcro, or other mechanisms that permit a full range of movement along mounting surface 116. In this manner, mounting bolsters 140 can be positioned to accommodate various sizes of objects 120 (e.g., a set of four corner-shaped mounting bolsters 140 can be placed relatively close together to accommodate a smaller painting and relatively far apart to accommodate a larger painting). Additionally, mounting bolsters 140 can be positioned so that objects 120 are located in an optimal position on mounting surface 116. In certain embodiments, the optimal position accommodates multiple objects 120 on the same mounting surface 116. In certain embodiments, the optimal position allows for positioning objects 120 such that the overall mass of the inner box 110 (including its contents) is centered at the isolator focal point in order to decouple system 100's vibration response.

In certain embodiments, a mounting bolster 140 comprises a positioning mechanism. The positioning mechanism allows for moving object 120 to any suitable position on mounting surface 116. In certain embodiments, the positioning mechanism allows for moving mounting bolster 140 horizontally (in the direction of the x-axis), vertically (in the direction of the y-axis), and diagonally (in any other direction in the x-y plane). For example, instead of using racks, channels, or similar structures that may constrain the movement of mounting bolster 140, the positioning mechanism may comprise one or more magnets, hook-and-loop fasteners (e.g., Velcro), or other mechanisms that permit a full range of movement along mounting surface 116. In this manner, mounting bolsters 140 can be positioned to accommodate various sizes of objects 120 (e.g., a set of four corner-shaped mounting bolsters 140 can be placed relatively close together to accommodate a smaller painting and relatively far apart to accommodate a larger painting). Additionally, mounting bolsters 140 can be positioned so that objects 120 are located in an optimal position on mounting surface 116. In certain embodiments, the optimal position accommodates multiple objects 120 on the same mounting surface 116. In certain embodiments, the optimal position allows for positioning objects 120 such that the overall mass of the inner box 110 (including its contents) is centered at the isolator focal point in order to decouple system 100's vibration response.

Figure 11A:
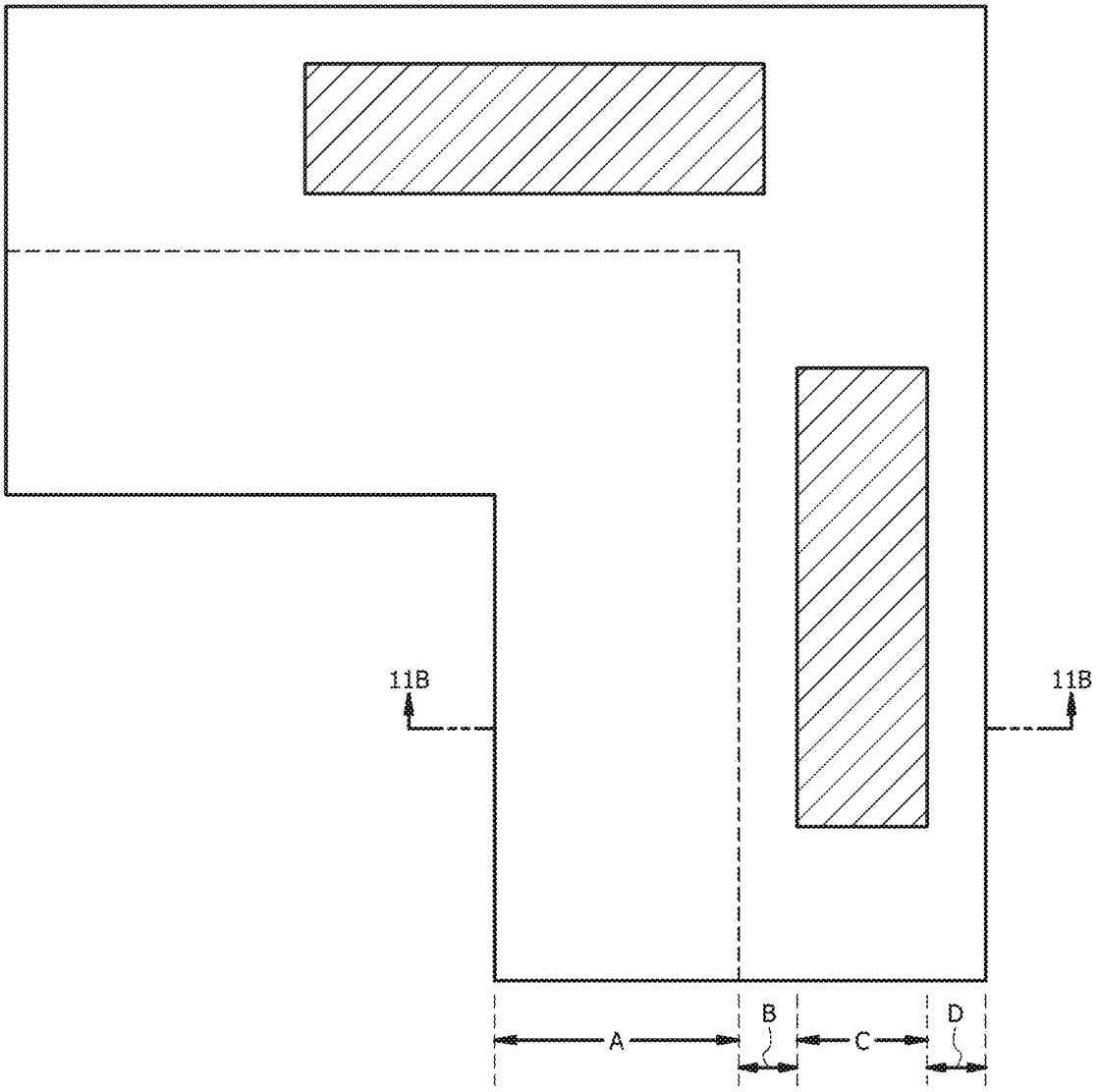
Figure 11B:
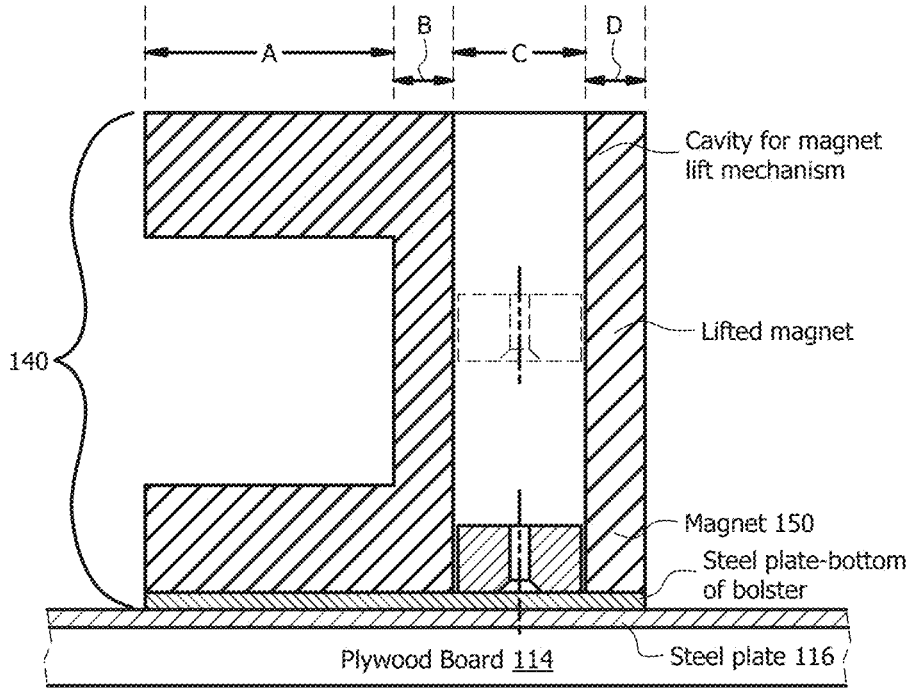

FIGS. 11A and 11B each illustrate magnets 150 positioned within mounting bolsters 140. In particular, FIG. 11A provides a top view of mounting bolster 140, and FIG. 11B provides a section view of the mounting bolster 140. Reference letters A, B, C, and D have been included to illustrate like and corresponding portions of FIGS. 11A and 11B. FIG. 11B illustrates a mounting bolster 140 that mounts to a mounting surface 116, shown as a steel plate in FIG. 11B. The mounting surface 116 provides a surface for a mounting board 114, shown as a plywood board in FIG. 11B. In the example of FIG. 11B, mounting bolster 140 comprises a cavity that houses one or more magnets 150. When the one or more magnets 150 are switched off, the one or more magnets 150 lift to release the mounting bolster 140 such that the mounting bolster 140 can be readily moved along the mounting surface 116 (or the mounting bolster 140 can be removed from the mounting surface 116). When the one or more magnets 150 are switched on, the one or more magnets 150 lock the mounting bolster 140 in place on the mounting surface 116.

Figure 14A:
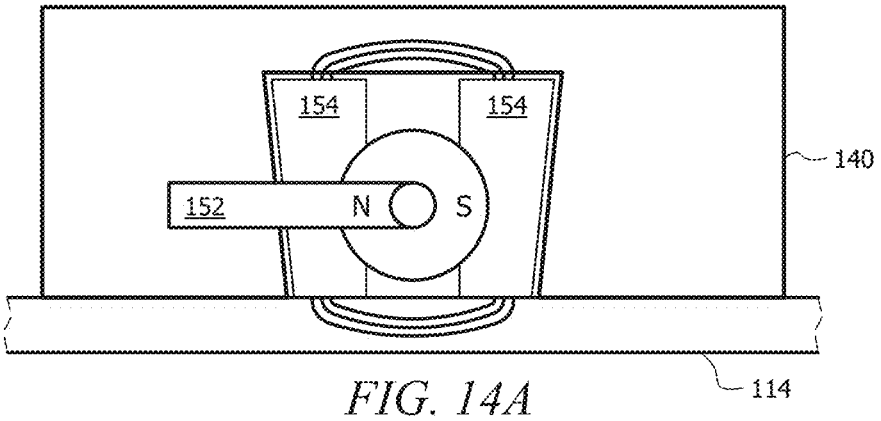
FIGS. 14A-14D illustrate an example arrangement of magnets that may be used in a positioning mechanism for a mounting bolster, in accordance with certain embodiments.
Figure 14B:
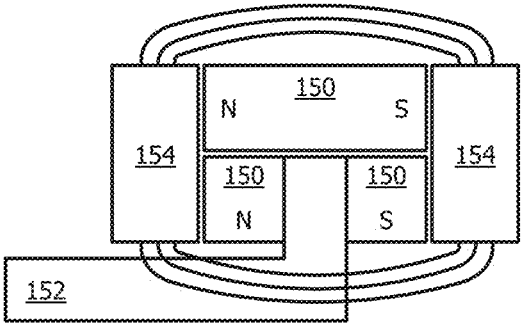
Figure 14C:
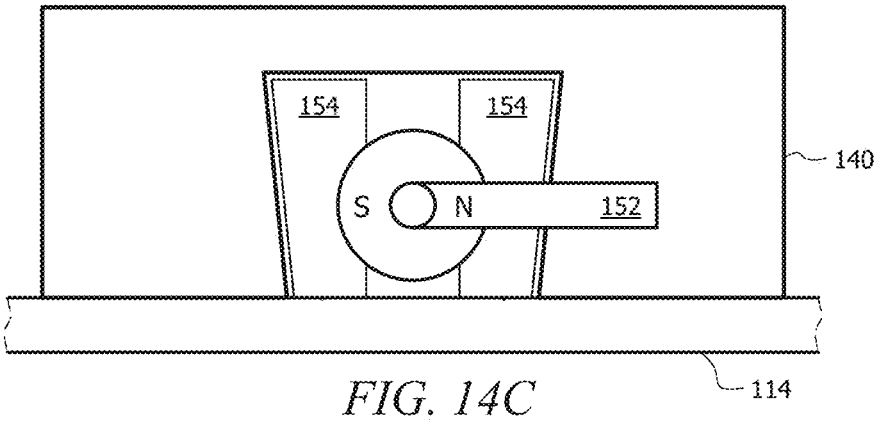
Figure 14D:
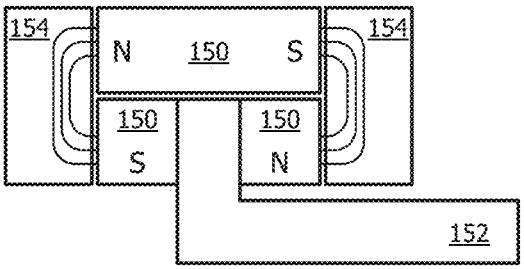

FIGS. 14A-14D illustrate an example arrangement of magnets 150 that may be used in a positioning mechanism for a mounting bolster 140, in accordance with certain embodiments. FIGS. 14A and 14B illustrate the plan and overhead views of a mounting bolster 140 comprising magnets 150 switched on such that the magnetic flux is directed toward mounting board 114 in order to lock the mounting bolster 140 in place. FIGS. 14C and 14D illustrate the plan and overhead views of a mounting bolster 140 comprising magnets 150 switched off such that the magnetic flux is directed away from the mounting board 114 in order to release the mounting bolster 140. A switch 152 can be used to switch the magnets 150 off or on by changing the North-South orientation of one or more magnets 150, which changes the path of the magnetic flux. Steel posts 154 can be used to convey the magnetic flux toward the mounting board 114 when the magnets 150 are switched on. Steel posts may comprise any suitable shape (e.g., block, cylinder, etc.) and size.

FIG. 14B illustrates details of the arrangement of magnets 150 corresponding to FIG. 14A (the arrangement when magnets 150 are switched on). In FIG. 14B, switch 152 is arranged such that the North pole of a first magnet 150 and the North pole of a second magnet 150 are both positioned on the same side (e.g., left side) of the magnet assembly. Similarly, the South pole of the first magnet 150 and the South pole of the second magnet 150 are both positioned on the same side (e.g., right side) of the magnet assembly. In this arrangement, the magnetic flux is directed between a first steel post 154 (e.g., the steel post 154 on the left side of the magnet assembly, nearest the North poles of the two magnets 150) and a second steel post 154 (e.g., the steel post 154 on the right side of the magnet assembly, nearest the South poles of the two magnets). As shown with reference to FIG. 14A, the magnet flux between the two steel posts 154 passes through mounting board 114 in order to lock the mounting bolster 140 in place.

FIG. 14D illustrates details of the arrangement of magnets 150 corresponding to FIG. 14C (the arrangement when magnets 150 are switched off). In FIG. 14D, switch 152 is arranged such that the North pole of the first magnet 150 and the North pole of the second magnet 150 are positioned on opposite sides of the magnet assembly (e.g., the North pole of the rear magnet is positioned on the left side of the magnet assembly, and the North pole of the front magnet is positioned on the right side of the magnet assembly). Similarly, the South pole of the first magnet 150 and the South pole of the second magnet 150 are positioned on opposite sides of the magnet assembly (e.g., the South pole of the rear magnet is positioned on the right side of the magnet assembly, and the South pole of the front magnet is positioned on the left side of the magnet assembly). This arrangement causes the magnetic flux lines to pass within the steel posts and avoids magnetic flux between the first steel post 154 (e.g., the steel post 154 on the left side of the magnet assembly) and the second steel post 154 (e.g., the steel post 154 on the right side of the magnet assembly). As shown with reference to FIG. 14C, essentially no magnet flux passes through mounting board 114, which releases the lock on mounting bolster 140 and allows the mounting bolster 140 to be readily detached from mounting board 114.

Figure 15A:
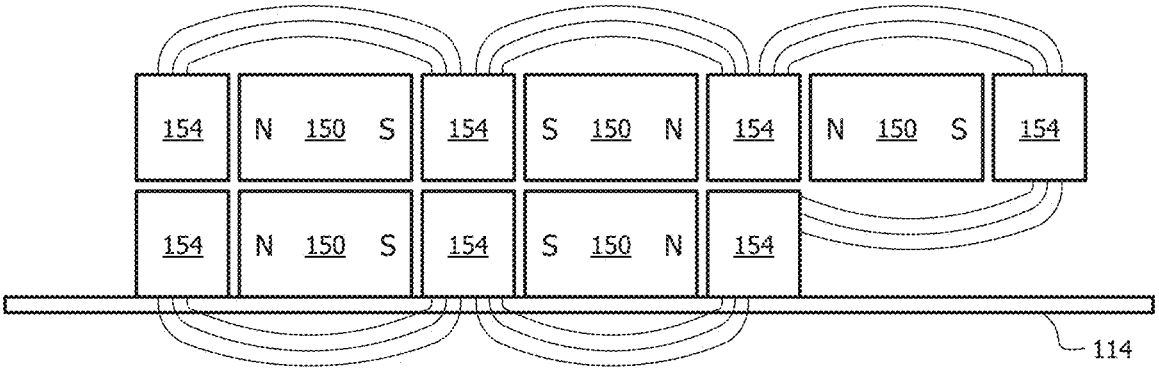
FIGS. 15A-15B illustrate an example arrangement of magnets that may be used in a positioning mechanism for a mounting bolster, in accordance with certain embodiments.
Figure 15B:
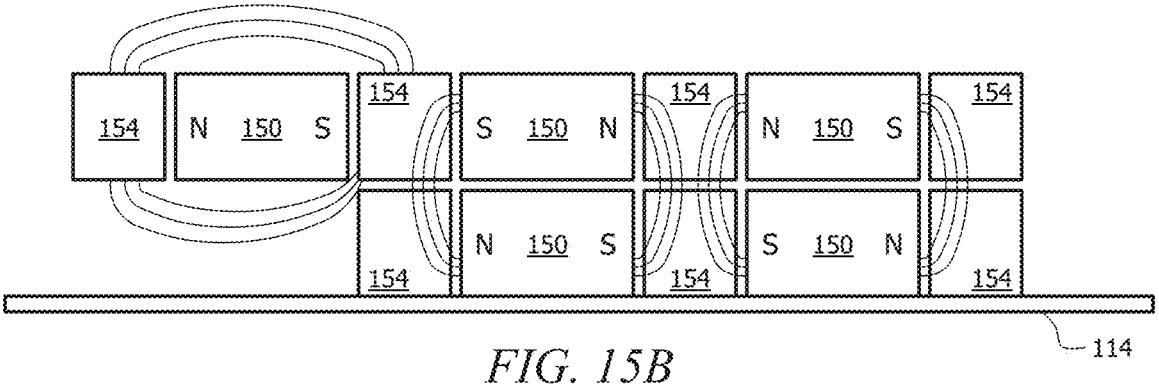

FIGS. 15A-15B illustrate an example arrangement of magnets 150 that may be used in a positioning mechanism for a mounting bolster 140, in accordance with certain embodiments. FIG. 15A illustrates the magnets 150 switched on such that the magnetic flux is directed toward mounting board 114 in order to lock the mounting bolster 140 in place. FIG. 15B illustrates the magnets 150 switched off by sliding the upper train of magnets of FIG. 15A to the left as shown in FIG. 15B such that the magnetic flux is directed away from the mounting board 114 in order to release the mounting bolster 140. A switch can be effected by a mechanism that slides the magnet train to switch the magnets 150 off (in the sense that magnets 150 release from mounting board 114) or on (in the sense that magnets 150 hold to mounting board 114) by changing the North-South orientation of one or more magnets 150, which changes the direction of the magnetic flux. Steel posts 154 can be used to convey the magnetic flux toward the mounting board 114 when the magnets 150 are switched on. Steel posts may comprise any suitable shape (e.g., block, cylinder, etc.) and size.

The examples of FIGS. 11A, 11B, 14A-14B, and 15A-15B may use any suitable magnets. As an example, certain embodiments may use one or more cylindrical shaped magnets having a diameter length in the range of approximately 0.25 inches to 4 inches and a thickness in the range of approximately 0.1 inches to 4 inches. In certain embodiments, the magnet may be diametrically magnetized. In other embodiments, the magnet may be axially magnetized. In certain embodiments, the magnet assembly may have a combined pull force greater than 5 pounds and less than 100 pounds. As examples, the pull force may be in the range of 5 to 25 pounds, 10 to 50 pounds, 20 to 50 pounds, 50 to 100 pounds, or other suitable range. Other embodiments may use other shapes, such as block-shaped magnets, other sizes, and/or other pull forces, for example, depending on the mass and dimensions of the mounting bolsters 140 and the objects 120 to be carried by the mounting bolsters 140. The number of magnets and the position of magnets within mounting bolster 140, as well as the shape, size, and/or pull force of the magnets may be selected to make sure that when being switched "on," the magnets do not slap down into position in a manner that may stress object 120 or pinch the fingers of a person that is positioning the mounting bolsters 140.

Figure 16A:
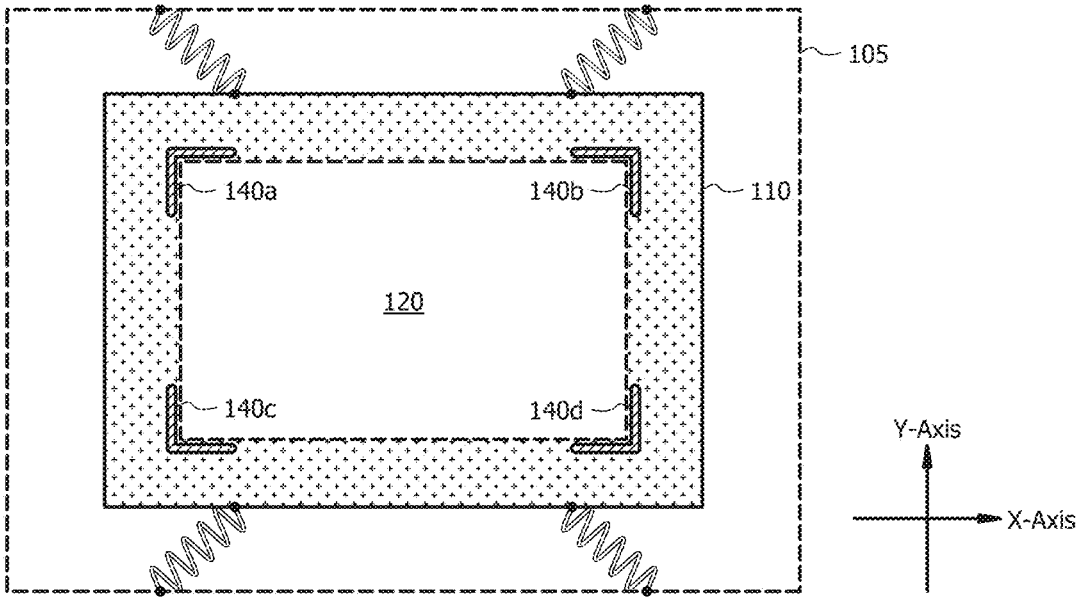
FIGS. 16A-16B illustrate examples of mounting one or more objects on a mounting surface, in accordance with certain embodiments.
Figure 16B:
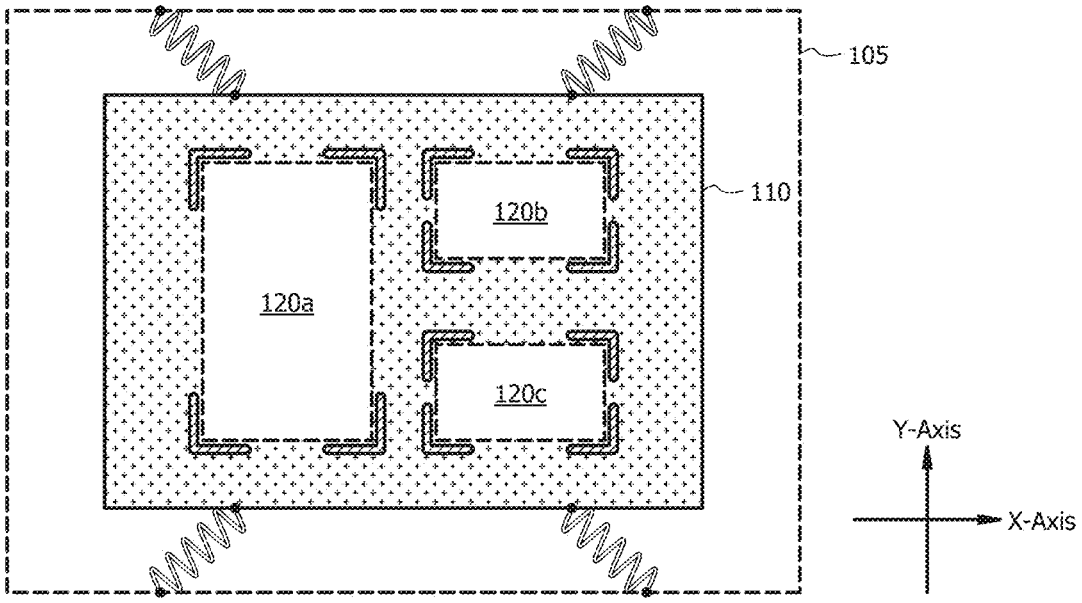

FIGS. 16A-16B illustrate examples of mounting one or more objects 120 on a mounting surface 116, in accordance with certain embodiments. As discussed above, certain embodiments comprise multiple mounting surfaces 116, such a front mounting surface 116*a* and a back mounting surface 116*b*. Each mounting surface 116 can carry one object 120 or multiple objects 120. Mounting bolsters 140 may be added or removed depending on the dimensions of an object 120 and how many objects 120 are to be carried by system 100. In the example of FIG. 16A, one object 120 has been mounted on mounting surface 116 (such as a front mounting surface 116*a*). A set of four corner-shaped mounting bolsters 140*a*, 140*b*, 140*c*, and 140*d* mount object 120 to mounting surface 116, with each mounting bolster 140 holding a respective corner of object 120. Optionally, additional mounting bolsters 140 could be used, such as linear shaped mounting bolsters 140 to increase support along the sides of object 120. In the example of FIG. 16B, three objects 120*a*, 120*b*, and 120*c* have been mounted on the same mounting surface 116 (such as a back mounting surface 116*b*). Each object 120*a*, 120*b*, and 120*c* is mounted with a respective set of four corner-shaped mounting bolsters 140.

In certain embodiments, mass units can be added to lower the system natural frequency and to ensure that the CG is at the isolator focal point. Thus, the mass units compensate for objects 120 having too little mass (e.g., if paintings carried by the inner box 110 are lighter than the mass to which vibration isolators 130 have been tuned). In certain embodiments, mass units can be mounted to a mounting board 114, for example, using mounting bolsters 140. In addition, or in the alternative, one or more mass units may be attached to an interior surface and/or an exterior surface of the inner box 110. Each mass unit can have a standardized or specified mass to simplify calculating the mass added by the mass units. In certain embodiments, the mass units are aluminum units containing phase change material to help maintain a stable temperature inside the inner box 110. In certain embodiments, the mass units 117 comprise inelastic particulate, such as lead shot, which may help damp vibrations. In some embodiments, the inelastic particulate may be suspended in gel. Alternatively, the inelastic particulate may be surrounded by air.

If the inner box 110 is not centered or is not loaded with sufficient mass, the inner box 110 may experience sway up to several inches in any direction. To minimize sway, it is important that the mass of the inner box 110 (including its contents) matches the mass to which the vibration isolators 130 are tuned, and that the CG of the inner box (including its contents) is centered at the isolator focal point. As an example, suppose vibration isolators 130 are tuned to a fixed mass of 90 kilograms such that vibrations in the critical range (e.g., 8-40 Hz) are not transmitted to objects 120 when the mass of the inner box (including its contents) is approximately 90 kilograms and centered. More generally, to effectively attenuate transmission of a specific range of vibrations, the mass should be matched with the tuning of the vibration isolators 130 (in other words, vibration isolators 130 should be tuned to the mass of the components suspended by vibration isolators 130).

As an example, the vibration-isolating system may be adapted to carry one or more paintings (e.g., stretched canvas painted with artwork). In certain embodiments, vibration isolators 130 may be tuned to attenuate vibrations in a pre-determined frequency range for a payload having a pre-determined mass. The pre-determined frequency range in turn determines the required natural frequencies of the system as well as the inner and outer box structures. The inner box 110 then vibrates with reduced amplitude and as a rigid solid thereby reducing the stress on the canvas and reducing the tendency for vibration at the art work's resonant frequencies (e.g., first, second or third drum frequencies of the canvas). In certain embodiments, the pre-determined frequency range to be damped begins at approximately 8-10 Hz and ends at approximately 40-50 Hz, such as 8-40 Hz, 8-50 Hz, 10-40 Hz, or 10-50 Hz, among others. In certain embodiments, the pre-determined mass is between 80-100 kilograms, such as 90 kilograms.

Suppose the vibration isolators 130 are tuned to attenuate vibrations in the pre-determined frequency range of 10-50 Hz for a payload having a pre-determined mass of 90 kilograms. The system natural frequency should be less than 7 Hz. Suppose the inner box 110, including its covers 112, mounting boards 114, and mounting bolsters 140, weighs 50 kilograms. As a first example, suppose loading the painting(s) plus any optional mass units adds 35 kilograms such that the combined mass of the components suspended by vibration isolators 130 is 85 kilograms. The mass of 85 kilograms causes the natural frequency to be increased to 7.2 ($f_{n2}=f_{n1}*\mathrm{sqrt}(m_1/m_2)$) Hz. The system is designed for the minimum anticipated weight. Any weight more than this is guaranteed to be sufficiently isolated from vibrations as the system natural frequency will decrease with additional mass leading to more attenuation. The maximum mass is determined by the isolator force/displacement curve.

In other embodiments, different vibration isolators 130 could be specified (e.g., wire thickness, number of loops, loop diameter, loop spacing, and/or number of wires in a rope braid could be adjusted) in order to tune the isolators to attenuate vibrations in the pre-determined frequency range of 10-50 Hz for a payload having a different pre-determined mass, such as 50 kilograms for a smaller case or 120 kilograms for a larger case, or other suitable value. Similarly, in other embodiments, different isolators 130 could be specified (e.g., wire thickness, number of loops, loop diameter, loop spacing, and/or number of wires in a rope braid could be adjusted) in order to tune the isolators to attenuate vibrations in a different pre-determined frequency range, depending on the resonant frequency of objects 120.

As discussed above, certain embodiments suspend an inner box 110 by four vibration isolators 130 (which may be arranged as described above with respect to FIG. 7A or 7B), and the embodiments include adjustable mounting bolsters 140 that allow for centering the payload around the center of gravity of the inner box 110. These embodiments may be well-suited to attenuating vibrations in the range of approximately 10-50 Hz. For example, these embodiments may reduce vibration in the critical range as compared to previous solutions, such as those described in U.S. Patent Publication 2017/0037928 and U.S. Patent Publication 2019/0367242. For example, the previous solutions described suspending a platform. By contrast, embodiments of the present disclosure suspend an inner box 110, which adds rigidity and therefore improves vibration isolation. As another example, in U.S. Patent Publication 2017/0037928, many isolators (e.g., ten isolators) were paired such that the pairs of isolators were opposed in the front-to-back, left-to-right, and top-to-bottom directions. However, the isolators in the previous solution were not focused on the center of gravity and the platform in the previous solution lacked a mechanism for centering the load at the center of gravity of platform. The stiffness in the z-direction was too great and the outer box and inner frame were not stiff enough to enable the isolators to work. In U.S. Patent Publication 2019/0367242, the isolators were attached proximate the corners of the platform. Embodiments of the present disclosure reduce vibrations by attaching vibration isolators 130 at attachment points that avoid locations within a certain distance of the corners, e.g., for the reasons discussed above with respect to FIGS. 5A-7B.

The various components described throughout this disclosure may be combined to form a vibration isolation system. The vibration isolation system may use any suitable combination of components, such as outer box 105, covers 107, inner box 110, covers 112, mounting boards 114, objects 120, mass units, vibration isolators 130, mounting corners 140, and/or other components. Examples of other components include one or more sensors that may optionally be mounted in or on outer box 105, inner box 110, mounting board 114, or object 120. Sensors may monitor and record vibrations and shocks occurring during transit, pressurization conditions, environmental conditions, GPS coordinates, surveillance cameras, and/or other suitable information. Additional examples of other components include humidity buffers, thermal controls (e.g., insulation materials, heating and cooling units, etc.), or other components selected to maintain optimal environmental conditions within inner box 110. Optionally, system 100 may be configured with one or more shock absorbing structures to absorb impact and prevent damage to objects 120 in transit. For example, in certain embodiments, one or more of the shock absorbing structures may compress or collapse quickly in the event of a shock (such as a drop or collision) and expand slowly after the shock to reduce rebound movement of inner box 110. In addition, or in the alternative, certain shock absorbing structures compress quickly in the event of a shock (such as a drop or collision) but do not decompress. Using a material that does not decompress may avoid rebound movement. If the structure remains compressed, it can be used as an indicator to identify whether system 100 was handled improperly. Examples of shock absorbing structures include replaceable structures composed of paper (e.g., honeycomb, fluted, and/or corrugated shaped structures), polypropylene, polycarbonate, polystyrene (e.g., closed cell expanded polystyrene (XPS) core), open cell polyurethane foam (smartfoam, Poron XRD, D30 and similar), and/or any suitable combination of the preceding.

Certain examples throughout this disclosure describe mounting surface 116 as positioned in a vertical orientation when system 100 is in a stationary and upright orientation. Other embodiments may position mounting surface 116 in any other suitable orientation, such as a horizontal orientation.

Certain embodiments of the present disclosure may provide one or more technical advantages. Certain embodiments may protect an object from damage due to vibrations, displacement, impact, temperature, and/or humidity. As discussed above, any suitable combination of the components described herein can be used to provide the desired protections.

Certain embodiments may have all, some, or none of the above-identified advantages. Other advantages will be apparent to persons of ordinary skill in the art.

Modifications, additions, or omissions may be made to the systems and apparatuses described herein without departing from the scope of the disclosure. The components of the systems and apparatuses may be integrated or separated. Moreover, the operations of the systems and apparatuses may be performed by more, fewer, or other components. Modifications, additions, or omissions may be made to the methods described herein without departing from the scope of the disclosure. The methods may include more, fewer, or other steps. Additionally, steps may be performed in any suitable order.

Although this disclosure has been described in terms of certain embodiments, alterations and permutations of the embodiments will be apparent to those skilled in the art.

Accordingly, the above description of the embodiments does not constrain this disclosure. Other changes, substitutions, and alterations are possible without departing from the spirit and scope of this disclosure, as defined by the following claims.

The invention claimed is:

1. A system, comprising:

an outer box;

an inner box, the inner box suspended within the outer box by one or more vibration isolators, the inner box comprising a mounting system adapted to facilitate mounting one or more objects within the inner box;

the inner box further comprising:

a front cover adapted to facilitate access to a first mounting surface of the mounting system when the front cover is open; and a back cover adapted to facilitate access to a second mounting surface of the mounting system when the back cover is open.

2. The system of claim 1, wherein an interior portion of the inner box is buffered from changes in temperature, relative humidity, or both when the front cover and the back cover are closed.

3. The system of claim 1, wherein:

the outer box comprises a plurality of outer box walls, the plurality of outer box walls comprising an outer box top wall, an outer box bottom wall, and a plurality of outer box side walls;

the inner box comprises a plurality of inner box walls, the plurality of inner box walls comprising an inner box top wall, an inner box bottom wall, and a plurality of inner box side walls;

the mounting system comprises a mounting surface; and the inner box is suspended such that when the system is in a stationary and upright orientation, the mounting surface is oriented vertically and none of the inner box walls directly contacts any of the outer box walls.

4. The system of claim 1, wherein the mounting system comprises:

a first mounting board; and a second mounting board, the second mounting board arranged parallel to the first mounting board and separated from the first mounting board by at least a distance.

5. The system of claim 4, wherein the distance is at least 25 millimeters.

6. The system of claim 4, wherein the distance yields a natural frequency of the first mounting board and the second mounting board greater than or equal to 100 Hz.

7. The system of claim 1, wherein the mounting system further comprises a plurality of mounting bolsters, each mounting bolster adapted to facilitate mounting the one or more objects onto a mounting surface of the mounting system, wherein each mounting bolster comprises a positioning mechanism adapted to facilitate:

moving the mounting bolster in any direction along the mounting surface when the positioning mechanism is arranged in a first mode; and locking the mounting bolster into a fixed position on the mounting surface when the positioning mechanism is arranged in a second mode.

8. The system of claim 7, wherein the positioning mechanism comprises one or more magnets.

9. The system of claim 7, wherein the positioning mechanism comprises hook and loop.

10. The system of claim 7, wherein each mounting bolster comprises a pad adapted to secure an object to the mounting bolster when the pad is in a first position and release the object from the mounting bolster when the pad is in a second position.

11. The system of claim 10, wherein the pad is adapted to be locked into the first position using a torque wrench.

12. The system of claim 1, wherein:

each of the one or more vibration isolators attaches to the inner box at a respective attachment point; and each attachment point avoids locations within a distance of an inner box corner nearest the respective attachment point.

13. The system of claim 12, wherein the one or more vibration isolators include at least one vibration isolator with an attachment point along a vertical surface of the inner box, and wherein the distance comprises at least 10% of a vertical dimension of the inner box.

14. The system of claim 12, wherein the one or more vibration isolators include at least one vibration isolator with an attachment point along a horizontal surface of the inner box, and wherein the distance comprises at least 10% of a horizontal dimension of the inner box.

15. The system of claim 1, wherein the one or more vibration isolators are substantially centered with respect to a depth dimension of the inner box.

16. The system of claim 1, wherein:

each of the plurality of vibration isolators attaches to the inner box at a respective attachment point; and each attachment point avoids locations for which a modal response associated with the location exceeds a threshold.

17. The system of claim 1, wherein the plurality of vibration isolators comprises at least four vibration isolators, wherein each of the four vibration isolators is focused on a center of gravity of the inner box.

18. The system of claim 1, wherein each vibration isolator of the one or more vibration isolators is tuned based on a force-displacement dynamic.

19. The system of claim 1, wherein the one or more vibration isolators are tuned to provide vibration isolation in a damage frequency range associated with the one or more objects.

20. The system of claim 1, wherein the plurality of vibration isolators comprises at least one multi-stage vibration isolator, the at least one multi-stage vibration isolator adapted to:

provide a first mode of vibration isolation in response to a first vibration amplitude; and provide a second mode of vibration isolation in response to a second vibration amplitude.

21. The system of claim 20, wherein the at least one multi-stage vibration isolator is further adapted to provide a third mode of vibration isolation that acts as a jounce bumper in response to a third vibration amplitude and/or damps a rebound associated with the response to the first vibration amplitude or the response to the second vibration amplitude.

22. The system of claim 1, wherein the plurality of vibration isolators comprises at least one multi-stage vibration isolator, the at least one multi-stage vibration isolator adapted to:

provide a first mode of vibration isolation in response to a first vibration amplitude; and provide a second mode of vibration isolation in response to a second vibration amplitude, wherein the second vibration amplitude is greater than the first vibration amplitude and the second mode of vibration isolation is more rigid than the first mode of vibration isolation.

23. The system of claim 1, further comprising:

disengaging the one or more vibration isolators to hold the mounting system steady while loading or unloading the one or more objects; and engaging the one or more vibration isolators when the mounting system is in transit.

24. The system of claim 1, further comprising a stopper that prevents at least one of the outer box or the inner box from closing or locking when while loading or unloading the one or more objects the.

25. The system of claim 1, wherein the one or more objects that the mounting system is adapted to facilitate mounting within the inner box comprise one or more fragile objects.

26. The system of claim 1, further comprising the one or more objects, wherein the one or more objects comprise one or more art objects.

27. The system of claim 1, further comprising the one or more objects, wherein the one or more objects comprise one or more stretched canvases painted with artwork, and wherein the one or more vibration isolators are tuned to a natural frequency that reduces damaging vibrations imparted on the stretched canvas so as to prevent paint from cracking, crazing, or separating from the stretched canvas.

28. The system of claim 1, wherein the one or more vibration isolators comprises at least one multi-stage vibration isolator, the at least one multi-stage vibration isolator adapted to provide one mode of vibration isolation in response to vibrations due to shock and to provide another mode of vibration isolation in response to other vibrations.

29. The system of claim 1, wherein the one or more vibration isolators comprises at least one multi-stage vibration isolator, the at least one multi-stage vibration isolator adapted to provide one mode of vibration isolation in response to vibrations due to a drop, fall, collision, or other impact on the system and to provide another mode of vibration isolation in response to vibrations due to transporting the system.

30. A system, comprising:

an outer box; and an inner box, the inner box suspended within the outer box by a plurality of vibration isolators, the inner box comprising a mounting system adapted to facilitate mounting one or more stretched canvases painted with artwork within the inner box, wherein the plurality of vibration isolators are tuned to reduce damaging vibrations imparted on the stretched canvas so as to prevent paint from cracking, crazing, or separating from the stretched canvas;

wherein:

each of the plurality of vibration isolators attaches to the inner box at a respective attachment point, each attachment point avoiding corners of the inner box by a distance of at least 10% of a length or width dimension of the inner box;

the mounting system comprises a first mounting board and a second mounting board, the second mounting board spaced apart from the first mounting board so as to increase a natural frequency of the first mounting board and the second mounting board;

the outer box comprises a plurality of outer box walls, the inner box comprises a plurality of inner box walls, and the inner box is suspended such that when the system is in a stationary and upright orientation, the first mounting board and the second mounting board are arranged vertically and none of the inner box walls directly contacts any of the outer box walls; and the mounting system comprises at least a first set of mounting bolsters, each mounting bolster in the first set of mounting bolsters adapted to facilitate mounting at least one of the one or more stretched canvases onto the first mounting board, wherein each mounting bolster comprises a positioning mechanism adapted to facilitate moving said mounting bolster in any direction along a mounting surface of the first mounting board when the positioning mechanism is arranged in a first mode and locking said mounting bolster into a fixed position on the mounting surface when the positioning mechanism is arranged in a second mode.

* * * * *